US005872501A

United States Patent [19]

Hamano et al.

[11] Patent Number: 5,872,501

[45] Date of Patent: Feb. 16, 1999

[54] RARE EARTH BONDED MAGNET AND RARE EARTH-IRON-BORON TYPE MAGNET ALLOY

[75] Inventors: Masaaki Hamano, Hiroshima; Minoru Yamasaki, Otake; Akihisa Indue; Akira Takeuchi, both of Sendai; Yuji Omote, Ichikawa, all of Japan

[73] Assignee: Toda Kogyo Corporation, Japan

[21] Appl. No.: 906,810

[22] Filed: Aug. 6, 1997

[30] Foreign Application Priority Data

Jul. 7, 1996 [JP] Japan ..... 8-226021
Dec. 18, 1996 [JP] Japan ..... 8-354297

[51] Int. Cl.[6] ..... H01H 67/02

[52] U.S. Cl. ..... 335/302; 252/62.51

[58] Field of Search ..... 335/296, 302, 335/303, 304, 306; 148/302; 252/62.51, 12.54, 62.55

[56] References Cited

U.S. PATENT DOCUMENTS 5,230,751 7/1993 Endoh et al. ..... 148/302
5,449,417 9/1995 Shimizu et al. ..... 148/302

FOREIGN PATENT DOCUMENTS 0 657 899 6/1995 European Pat. Off. .
WO 92/15995 9/1992 WIPO .

OTHER PUBLICATIONS

Patent Abstracts of Japan Publication No. 08124730 publication date 17–05–96 Rare Earth Resin Magnet Having Low Coercive Force.

*Primary Examiner*—Lincoln Donovan
*Attorney, Agent, or Firm*—Nixon & Vanderhye

[57] ABSTRACT

A rare earth bonded magnet obtained by mixing two types of magnetic powders (A) and (B) in the present invention has a high residual magnetic flux density (Br), a large intrinsic coercive force (iHc) and a large maximum energy product ((BH)max) in spite of a low rare earth element content, and shows an excellent rust preventability. A rare earth-iron-boron type magnet alloy of the present invention has a residual magnetic flux density (Br) as high as not less than 10 kG, an intrinsic coercive force (iHc) as large as not less than 3.5 kOe and a large maximum energy product ((BH) max) and which has an excellent rust preventability.

29 Claims, 4 Drawing Sheets

RARE EARTH BONDED MAGNET AND RARE EARTH-IRON-BORON TYPE MAGNET ALLOY

BACKGROUND OF THE INVENTION

The present invention relates to a rare earth bonded magnet and a rare earth-iron-boron type magnet alloy, and more particularly, to a rare earth bonded magnet which has a high residual magnetic flux density (Br), a large intrinsic coercive force (iHc) and a large maximum energy product ((BH)max) in spite of a low rare earth element content, a rare earth-iron-boron type magnet alloy which has a residual magnetic flux density (Br) as high as not less than 10 kG, an intrinsic coercive force (iHc) as large as not less than 3.5 kOe and a large maximum energy product ((BH)max) and which has an excellent rust preventability, a process for producing the rare earth-iron-boron type magnet alloy, and a bonded magnet produced from such a rare earth-iron-boron type magnet alloy.

Bonded magnets which are advantageous in that they can be produced in any shape and have a high dimensional accuracy, etc., have conventionally been used in various fields such as electric appliances and automobile parts. With a recent development of miniaturized and lightweight electric appliances and automobile parts, bonded magnets used therefor have been strongly required to be miniaturized.

For this purpose, magnets have been strongly required to have a high residual magnetic flux density (Br), a large intrinsic coercive force (iHc) and, as a result, a large maximum energy product ((BH)max).

Bonded magnets using magneto plumbite type ferrite (referred to as 'ferrite bonded magnet' hereinunder) which have conventionally been used for bonded magnets have an excellent rust preventability because ferrite is an oxide. In addition, since the ferrite bonded magnets are produced from a cheap material such as oxides of barium and strontium and an iron oxide, the ferrite bonded magnets are economical and are, therefore, widely used.

As to the magnetic characteristics of a general ferrite bonded magnet, however, the residual magnetic flux density (Br) is about 2 to 3 kG, the intrinsic coercive force (iHc) is about 2 to 3 kOe, and the maximum energy product ((BH) max) is about 1.6 to 2.3 MGOe.

Conventionally, rare earth bonded magnets represented by Nd-type isotropic compression-molded magnets are widely used for electric appliances in the form of magnets for motors. Especially, the rare earth bonded magnets are widely used for appliances mounted on computers such as hard disk drives (HDD) and CD-ROMs, peripheral devices of computers such as printers and scanners, and portable communication devices such as pocket telephones.

With the miniaturization and lightweight of the electric appliances and automobile parts, it is strongly demanded to provide a magnet which has higher magnetic characteristics and which is more economical. For example, as compared with the Nd-type isotropic bonded magnet, a rare earth sintered magnet (Nd-type or Sm-type) and a Sm-type anisotropic bonded magnet have a large maximum energy product ((BH)max), but are inferior in economical and they are therefore hardly used for electric appliances in the form of magnets for the above-mentioned motors.

As the magnet powder as a material of Nd-type isotropic compression-molded bonded magnets, the magnet powder MQP (trade name, produced by MQI Corp.) developed by GM Corp. in USA is only one at present which is supplied on an industrial scale. Especially, the magnet powder of MQP-B grade is chiefly used. The general composition of the MQP-B powder is $Nd_{12}Fe_{76.5}Co_{5.5}B_6$ in the vicinity of the stoichiometeric composition of an $Nd_2Fe_{14}B_1$ type crystal structure. As to the nominal magnetic characteristics, the residual magnetic flux density (Br) is 8.2 kG, the intrinsic coercive force (iHc) is 9.0 kOe, the maximum energy product ((BH)max) is 12.0 MGOe. As to the magnetic characteristics of a compression-molded bonded magnet (MQI-B10) produced from this magnet powder, the residual magnetic flux density (Br) is 6.9 kG, the intrinsic coercive force (iHc) is 9.0 kOe, the maximum energy product ((BH) max) is 10.0 MGOe.

Japanese Patent Application Laid-Open (KOKAI) No. 8-124730 (1996) describes a rare earth resin magnet having an intrinsic coercive force as low as 4 to 10 kOe, which is produced by mixing a rapidly chilled powder having a composition in the vicinity of the stoichiometeric composition of $Nd_2Fe_{14}B_1$ in which Nd is 12±0.5 atm % and an intrinsic coercive force iHc of 10 kOe and an exchange-spring magnet constituted by a soft magnetic phase and a hard magnetic phase in which crystal grain size is controlled to 20 to 50 nm, and solidifying the obtained mixture with a resin. However, the object of the invention of Japanese Patent Application Laid-Open (KOKAI) No. 8-124730 (1996) is to provide a rare earth resin magnet having an excellent multipolar-magnetizability. Therefore, the invention of Japanese Patent Application Laid-Open (KOKAI) No. 8-124730 (1996) is aimed at lowering the intrinsic coercive force by mixing powders. The magnetic characteristics described in the Examples do not exceed those of the MQI-B10.

As described above, in spite of an increasing demand for magnets which have a high magnetic force and which can be economically produced, no magnet which satisfies the demand from the point of view of both performance and economy has ever been proposed.

There is no end to a demand for a higher performance and a lower price of a magnet. To meet such a demand, rare earth-iron-boron type alloys for exchange-spring magnets using Nd as a rare earth element have been earnestly developed and some of them have already been put to practical use.

An exchange-spring magnet exhibits a magnetic spring phenomenon by the exchange interaction of iron or an iron compound and an $Nd_2Fe_{14}B_1$ type tetragonal compound. Those magnets are characterized in a low rare earth element content and a high residual magnetic flux density (Br), and have a high possibility of being excellent on a cost/performance basis.

A rare earth-iron-boron type alloy for exchange-spring magnets containing less than 10 atm % of a rare earth element such as Nd, has a high potential in magnetic characteristics as compared with a rare earth-iron-boron type magnet alloy containing about 10 to 15 atm % of a rare earth element such as Nd which is in the vicinity of the stoichiometeric composition, e.g., commercially available "MQP" (trade name)" developed by General Motors. Since it is possible to reduce the amount of expensive rare earth element used, this alloy is economically advantageous.

The rare earth-iron-boron type alloy for exchange-spring magnets containing less than 10 atm % of a rare earth element such as Nd is divided into two systems as the soft magnetic phase: one is a system containing αFe or bccFe, and the other is a system containing $Fe_3B$ or $Fe_2B$. The former generally has a residual magnetic flux density (Br) as high as 10 to 13 kG but the intrinsic coercive force (iHc) thereof is as low as 3.5 kOe at most. The latter generally has a comparatively high intrinsic coercive force (iHc) such as 3.5 to 7.7 kOe, but the residual magnetic flux density (Br) thereof is as low as less than 10 kG, which is higher than that of "MQP" but lower than that of the former αFe system.

In the field of small-sized motors for which bonded magnets produced from a rare earth-iron-boron type magnet alloy is mainly used, bonded magnets are required to have well-balanced residual magnetic flux density (Br) and an intrinsic coercive force (iHc) from the point of view of miniaturized of motors and magnetic stability of the magnets used therefor. That is, magnets are strongly required to have a residual magnetic flux density (Br) of not less than 10 kG and an intrinsic coercive force (iHc) of not less than 3.5 kOe.

On the other hand, an alloy containing rare earth elements in an Nd system is defective in that it is easily oxidized in the air and is likely to produce an oxide, so that the rust preventability is poor. Since bonded magnets produced from an alloy containing a rare earth element in an Nd system have a poor rust preventability, they are usually subjected to rust preventive coating-treatment such as dipping, spread coating or electro deposition using a resin and metal plating.

If the rust preventability of an alloy containing a rare earth element in an Nd system is enhanced, it may be possible to simplify or omit the rust preventive coating step for the surfaces of bonded magnets even for the above-described use. In some uses of general-purpose motors, there is a possibility of omitting the rust preventive coating step. Therefore, the enhancement of the rust preventability of a rare earth-iron-boron type magnet alloy is strongly demanded.

As described above, there is also a strong demand for the economical production of a rare earth-iron-boron type magnet alloy which has a high residual magnetic flux density (Br), a comparatively large intrinsic coercive force (iHc), and as a result, a large maximum energy product ((BH)max), and an excellent rust preventability.

In conventional quenched permanent magnet materials which contain Fe as the main ingredient (less than 91 atm %) and further contain at least one rare earth element (R) and boron (B), a permanent magnet material is known which comprises less than 10 area % of a soft magnetic residual amorphous phase based on the total alloy structure and a crystalline phase as the balance which is substantially produced by heat-treatment and which contains an R—Fe—B type hard magnetic compound (Japanese Patent Application Laid-Open (KOKAI) No. 8-162312 (1996)).

Although the economical production of a rare earth-iron-boron type magnet alloy which has a high residual magnetic flux density (Br), a comparatively large intrinsic coercive force (iHc), and as a result, a large maximum energy product ((BH)max), and an excellent rust preventability is now in the strongest demand, no magnet ever produced has such properties.

In the rare earth-iron-boron type magnet alloy described in Japanese Patent Application Laid-Open (KOKAKI) No. 8-162312 (1996)), the intrinsic coercive force (iHc) is as low as less than 3 kOe and the residual magnetic flux density (Br) is as low as less than 10 kG, as is clear from Table 5 in the specification in which the residual magnetic flux density (Br) is about 0.62 to 0.97 T (equivalent to 6.2 to 9.7 kG), the intrinsic coercive force (iHc) is about 0.16 to 0.21 MA/m (equivalent to 1.25 to 2.6 kOe), the maximum energy product ((BH)max) is about 19.7 to 72.0 kJ/m$^3$ (equivalent to 2.5 to 9.0 MGOe).

The rare earth-iron-boron type magnet alloys described in Examples 2 to 4 of Japanese Patent Application Laid-Open (KOKAI) No. 8-162312 (1969) are bulk bodies obtained by pulverizing a quenched ribbon and extruding the pulverized particles under a vacuum. The bulk bodies are, therefore, different from a rare earth-iron-boron type magnet alloy as a raw material for bonded magnets in its configuration.

The theoretical energy product of a permanent magnet is generally represented by: $(BH)max=0.25\times Br^2$. Therefore, in order to obtain a bonded magnet having a higher energy product than MQI-B10, it is essential to use magnetic powder having a higher Br. In this case, with respect to intrinsic coercive force (iHc), if the condition: $iHc>0.5\times Br$ is satisfied, the squareness is not impaired and the energy product is not lowered. It is, therefore, possible to use magnetic powder having a lower intrinsic coercive force (iHc) than that of MQI-B10 so long as the above-described condition is satisfied.

The present inventors have hit upon an idea of mixing two types of magnetic powders (A) and (B) in order to improve the magnetic characteristics of a bonded magnet. As a result of various experiments using an exchange-spring magnet powder (B) in an αFe—NdFeB system and a magnetic powder (A) which contains a smaller amount of rare earth element than the MQP-B magnetic powder and is therefore economically advantageous, and which has a lower residual magnetic flux density (Br) than the magnetic powder (B) but an intrinsic coercive force (iHc) of not less than 7 kOe which is higher than that of the magnetic powder (B), by the combination of specific magnetic powder (A) and specific exchange-spring magnet powder (B), it has been found that a bonded magnet having the magnetic characteristics of a residual magnetic flux density (Br) of not less than 8 kG, an intrinsic coercive force (iHc) of not less than 5 kOe and a large maximum energy product ((BH)max) of not less than 11 MGOe has been firstly produced. Namely, it has been found that this bonded magnet is more excellent in residual magnetic flux density (Br) and maximum energy product ((BH)max) than the bonded magnet MQI-B10 in spite of a lower intrinsic coercive force (iHc), and that it is more excellent from the point of view of economy. On the basis of this finding, the present invention has been achieved.

SUMMARY OF THE INVENTION

It is an object of the present invention to economically provide a bonded magnet which has a higher residual magnetic flux density (Br) than that of the MQI-B10, an intrinsic coercive force (iHc) which is so high as not to impair the squareness, and as a result, a larger maximum energy product ((BH)max) than that of the MQI-B10.

It is another object of the present invention to economically provide a rare earth-iron-boron type magnet alloy which has a high residual magnetic flux density (Br), a comparatively large intrinsic coercive force (iHc) and as a result, a large maximum energy product ((BH)max), and shows an excellent rust preventability.

To achieve these aims, in a first aspect of the present invention there is provided a rare earth bonded magnet comprising:

a magnet powder (A) represented by the following formula (1), which comprises $Nd_2Fe_{14}B_1$ type crystals, which has an intrinsic coercive force (iHc) of not less than 7 kOe, and which has an average particle diameter of not less than 100 μm:

$$R_a(Fe_{(1-d)}Co_d)_{(100-a-b-c)}M^1{}_bB_c \quad (1)$$

wherein $M^1$ is at least one element selected from the group consisting of Ti, V, Cr, Zr, Nb, Mo, Hf, Ta, W, Mn, Cu and Ni, R is at least one element selected from the group consisting of Nd, Pr, Dy, Tb and Ce, a is 8 to 11 (atm %), b is 0.1 to 10 (atm %), c is 2 to 10 (atm %) and d is 0 to 0.2 (atm %);

a magnetic powder (B) represented by the following formula (2), which has an average particle diameter of not more than 50 μm:

$$R_xFe_{(100-w-x-y-z)}Co_yM^2_zB_w \quad (2)$$

wherein $M^2$ is at least one element selected from the group consisting of Ti, V, Cr, Zr, Nb, Mo, Hf, Ta, W, Mn, Cu, Ga, Zn, In, Sn, Bi, Ag and Si, R is one element selected from the group consisting of Nd, Pr, Dy, Tb and Ce, x is 5 to 10 (atm %), y is 1 to 9 (atm %), z is 0.1 to 5 (atm %), w is 2 to 7 (atm %) and (x+w) is not less than 9 (atm %); and a binder resin.

In a second aspect of the present invention, there is provided a rare earth bonded magnet comprising:

a magnet powder (A) represented by the following formula (1), which comprises $Nd_2Fe_{14}B_1$ type crystals, which has an intrinsic coercive force (iHc) of not less than 7 kOe, and which has an average particle diameter of not less than 100 μm:

$$R_a(Fe_{(1-d)}Co_d)_{(100-a-b-c)}M^1_bB_c \quad (1)$$

wherein $M^1$ is at least one element selected from the group consisting of Ti, V, Cr, Zr, Nb, Mo, Hf, Ta, W, Mn, Cu and Ni, R is at least one element selected from the group consisting of Nd, Pr, Dy, Tb and Ce, a is 8 to 11 (atm %), b is 0.1 to 10 (atm %), c is 2 to 10 (atm %) and d is 0 to 0.2-(atm %);

a magnetic powder (B) represented by the following formula (2), which has an average particle diameter of not more than 50 μm:

$$R_xFe_{(100-w-x-y-z)}Co_yM^2_zB_w \quad (4)$$

wherein R is one element selected from the group consisting of Nd, Pr, Dy, Tb and Ce, $M^2$ is at least one element selected from the group consisting of Ti, V, Cr, Zr, Nb, Mo, Hf, Ta, W, Mn, Cu, Ga, Zn, In, Sn, Bi, Ag and Si, x is 5 to 10 (atm %), y is 1.0 to 9.0 (atm %), z is 0.1 to 5 (atm %), w is 2 to 7 (atm %), (x+w) is not less than 9 (atm %) and (y+z) is not less than 5 (atm %); and a binder resin.

In a third aspect of the present invention, there is provided a rare earth-iron-boron type magnet alloy having a composition represented by the following formula (5):

$$R_xFe_{(100-w-x-y-z)}Co_yM^4_zB_w \quad (5)$$

wherein R is one element selected from the group consisting of Nd, Pr, Dy, Tb and Ce, $M^4$ is at least one element selected from the group consisting of Ti, V, Cr, Zr, Nb, Mo, Hf, Ta, W, Mn, Cu, Ga, Ag and Si, x is 5 to 10 (atm %), y is 1.0 to 9.0 (atm %), z is 0.1 to 5 (atm %), w is 2 to 7 (atm %), (x+w) is not less than 9 (atm %) and (y+z) is not less than 5 (atm %), which rare earth-iron-boron type magnet alloy comprises a structure in which each of a soft magnetic crystalline phase containing αFe, bccFe and a solid solution of αFe or bccfe and $M^4$ and a hard magnetic crystalline phase constituted by $Nd_2Fe_{14}B_1$ type tetragonal crystals is precipitated into a soft magnetic amorphous phase, in which the ratio of said soft magnetic amorphous phase is not more than 10 area % based on the total alloy structure, and the balance is a crystalline phase comprising said soft magnetic crystalline phase and said hard magnetic crystalline phase, and in which the ratio of said soft magnetic crystalline phase is not less than 50 area % based on the total crystalline structure and the balance is said hard magnetic crystalline phase.

In a fourth aspect of the present invention, there is provided a process for producing a rare earth-iron-boron type magnet alloy as defined in the third aspect, comprising the steps of:

producing a mixture having a composition represented by the following formula (5):

$$R_xFe_{(100-w-x-y-z)}Co_yM^4_zB_w \quad (5)$$

wherein R is one element selected from the group consisting of Nd, Pr, Dy, Tb and Ce, $M^4$ is at least one element selected from the group consisting of Ti, V, Cr, Zr, Nb, Mo, Hf, Ta, W, Mn, Cu, Ga, Ag and Si, x is 5 to 10 (atm %), y is 1.0 to 9.0 (atm %), z is 0.1 to 5 (atm %), w is 2 to 7 (atm %), (x+w) is not less than 9 (atm %) and (y+z) is not less than 5 (atm %);

melting said obtained mixture under heating to produce a molten alloy;

quenching and solidifying said molten alloy; and heat-treating the quenched and solidified alloy in the temperature range of 600° to 850° C.

In a fifth aspect of the present invention, there is provided a bonded magnet produced by molding magnet alloy powder obtained by pulverizing said rare earth-iron-boron type magnet alloy as defined in the third aspect and a resin as a binder, the content of said magnet alloy powder in the bonded magnet being 85 to 99 wt %.

DETAILED DESCRIPTION OF THE INVENTION

Figure 1:
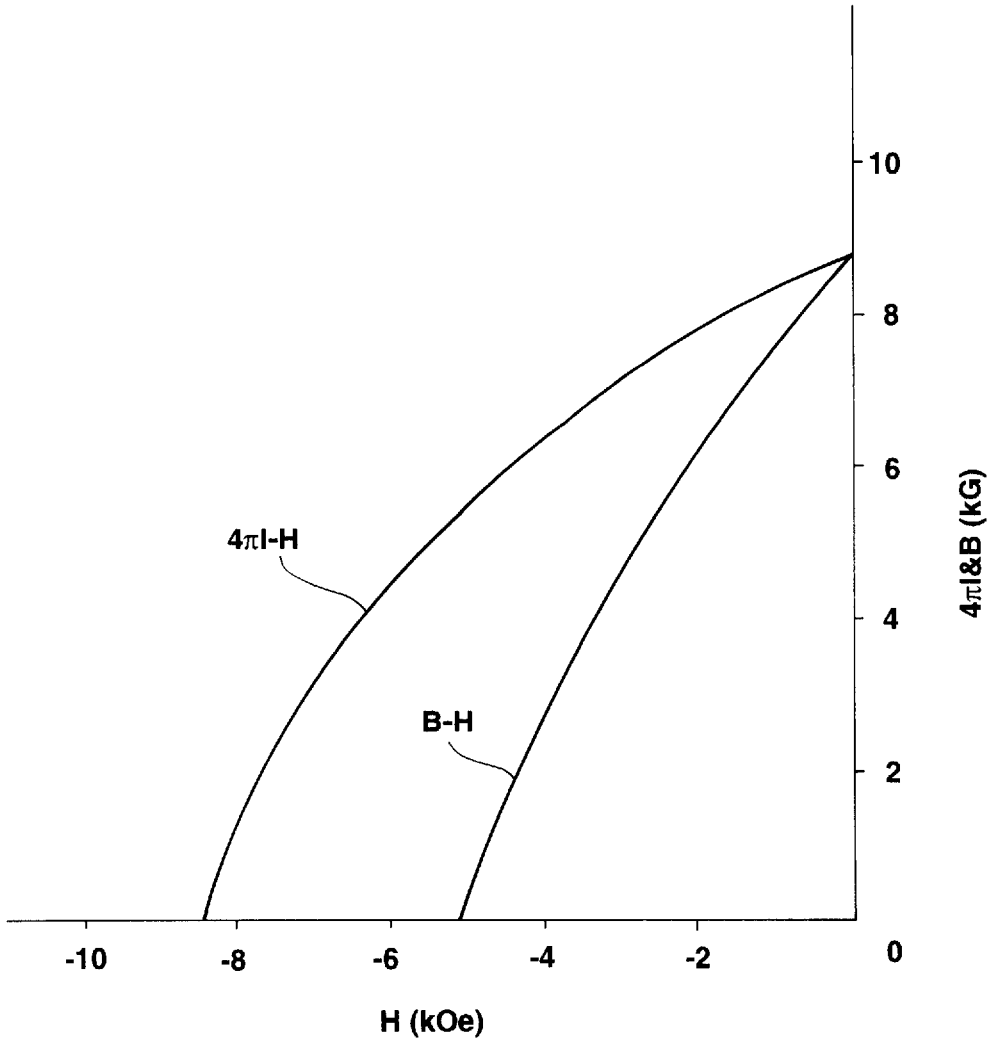
FIG. 1 shows the demagnetization curve of a rare earth bonded magnet Example 1 in which the ratio of magnetic powders (A)/(B)=50/50.

The magnetic powder (A) as one constituent of a rare earth bonded magnet according to the present invention has a composition represented by the formula (1), comprises $Nd_2Fe_{14}B_1$ type crystals, has an intrinsic coercive force (iHc) of not less than 7 kOe, and has an average particle diameter of not less than 100 μm. Preferably, the magnetic powder (A) is a powder obtained by pulverizing a quenched ribbon, which has a composition represented by the formula (1), which contains usually 8 to 11 atm % of a rare earth element, which has an intrinsic coercive force (iHc) of not less than 7.5 kOe and which has an average particle diameter of 100 to 300 μm.

Also, as the magnetic powder (A) used in the present invention, a known magnet material which has a composition represented by the formula (1), contains preferably 8 to 11 atm % of a rare earth element, and has an intrinsic coercive force (iHc) of not less than 7 kOe, and which is produced by a liquid quenching method and heat-treatment (when the optimum quenching is adopted, the heat-treatment step may be omitted), may be used.

A reason why the intrinsic coercive force (iHc) is set to be not less than 7 kOe, is to secure an intrinsic coercive force (iHc) high enough not to impair the squareness of the demagnetization curve of the bonded magnet when the magnetic powders (A) and (B) are mixed, because the intrinsic coercive force of the magnetic powder (B) is generally as low as about 6 kOe at most. The upper limit of the intrinsic coercive force (iHc) is not specifically set, but the upper limit thereof is preferably 17 kOe with the consideration of the magnetizability of the bonded magnet.

Since the content of the rare earth element is usually 8 to 11 atm %, it is possible to reduce the amount of expensive rare earth element used as compared with the magnetic powder MQP-B. The magnetic powder obtained has an adequately high intrinsic coercive force (iHc), a larger maximum energy product ((BH)max) and an excellent magnetizability.

The magnetic powder (A) is generally said to have only $Nd_2Fe_{14}B_1$ type crystal phase or a mixed phase comprising the $Nd_2Fe_{14}B_1$ type crystal phase as the main phase and a trace amount of grain boundary phase. The crystal grain diameter is several 10 nm. However, since the alloy is susceptible to the influence of a strain caused by pulverization, if the pulverized grain size is diminished, the intrinsic coercive force is gradually lowered. The lower limit of the pulverized grain size is therefore about 100 μm for practical use.

From the point of view of the magnetic characteristics, in the composition of the magnetic powder (A) which is represented by the formula (1), it is preferable that a is 8.5 to 11, more preferably 9 to 11 (atm %), b is 0.5 to 5, more preferably 0.5 to 3 (atm %), c is 3 to 9, more preferably 4 to 8 (atm %), and d is 0.01 to 0.2, more preferably 0.01 to 0.15 (atm %).

Examples of the magnetic powder usable as the magnetic powder (A) are:

(A1) $Nd_{11}Fe_{79}Nb_2Ta_2B_6$ (magnetic characteristics of a quenched ribbon: Br=8.3 kG, iHc=14.9 kOe, (BH) max=14.0 MGOe) disclosed in Japanese Patent Application Laid-Open (KOKAI) No. 64-703 (1989);

(A2) $Nd_8Fe_{70}Co_{10}Zr_3Ti_1B_8$ (magnetic characteristics of a quenched ribbon: Br=8.6 kG, iHc=11.1 kOe, (BH) max=15.2 MGOe) disclosed in Japanese Patent Application Laid-Open (KOKAI) No. 64-7502 (1989);

(A3) $Nd_{11}Fe_{72}Co_8V_{1.5}B_{7.5}$ (magnetic characteristics of a quenched ribbon: Br=9.7 kG, iHc=12.9 kOe, (BH) max=20.1 MGOe) disclosed in Japanese Patent Publication No. 4-47024 (1992);

(A4) $Nd_{8.5}Fe_{70}Co_{10}Zr_3Ti_{0.5}B_8$;

(A5) $Nd_9Dy_{0.5}Fe_{70.5}Co_{10}Ni_1Nb_3B_6$;

(A6) $Nd_8Fe_{79.5}Cr_{4.5}B_8$;

(A7) $Nd_8Fe_{71}Co_{10}Zr_3B_8$;

(A8) $Nd_8Fe_{70}Co_{10}Zr_3Ti_1B_8$;

(A9) $Nd_{8.5}Fe_{71.5}Co_8Cu_1Ti_3B_8$;

(A10) $Nd_{8.5}Fe_{83.5}V_3B_5$;

(A11) $Nd_9Fe_{72}Co_{10}V_{1.5}B_{7.5}$;

(A12) $Nd_9Fe_{79.5}Mn_1Zr_3B_{7.5}$;

(A13) $Nd_9Fe_{72}Co_7Ta_4B_8$;

(A14) $Nd_9Fe_{70.5}Co_{12}Nb_{3.5}B_5$;

(A15) $Nd_9Fe_{73.5}Co_7Cr_4B_{6.5}$;

(A16) $Nd_{9.5}Fe_{70.5}Co_{10}Ni_1Nb_3B_6$;

(A17) $Nd_{9.5}Fe_{72}Co_7Zr_4B_{7.5}$;

(A18) $Nd_{10}Fe_{71}Co_{10}V_{1.5}B_{7.5}$;

(A19) $(Nd_7Pr_3)\ Fe_{66}Co_{16}V_1B_7$;

(A20) $Nd_{10.5}Fe_{82.5}Zr_2B_5$;

(A21) $Nd_{10.5}Fe_{82.5}Nb_2B_5$;

(A22) $Nd_{10.5}Fe_{72.5}Co_{10}Nb_2B_5$;

(A23) $Nd_{10.5}Fe_{75.5}Co_7W_2B_5$;

(A24) $Nd_{10.5}Fe_{70.5}Co_{10}Mo_4B_5$;

(A25) $Nd_{10.5}Fe_{72.5}Co_{10}Hf_2B_5$;

(A26) $(Nd_8Pr_{2.5})Fe_{75.5}Co_7V_2B_5$;

(A27) $Nd_{11}Fe_{79}Nb_2Ta_2B_6$;

(A28) $Nd_{11}Fe_{72}Co_8V_{0.5}B_{8.5}$;

(A29) $(Nd_9Pr_2)Fe_{70}Co_{10}Nb_2Ta_1B_6$; and (A30) $(Nd_{10}Pr_1)Fe_{69}Co_{10}Nb_2Ta_2B_6$.

The magnetic powder (B) which is one constituent of the rare earth bonded magnet according to the present invention is a magnetic powder having a composition represented by the formula (2) and an average particle diameter of not more than 50 μm. Preferably, a magnetic powder having a composition represented by the formula (2) is a powder obtained by pulverizing an exchange-spring magnet ribbon comprising a crystalline phase comprising a soft magnetic crystalline phase with the crystal grain diameters limited usually to 10 to 100 nm and a hard magnetic crystalline phase with the crystal grain diameters limited usually to 10 to 100 nm, and a soft magnetic amorphous phase of not more than 10 area % based on the total alloy structure, which contains usually not more than 10 atm %, more preferably 5 to 10 atm % of a rare earth element, which have an intrinsic coercive force (iHc) of usually 3.5 to 6.0 kOe and a residual magnetic flux density (Br) of not less than 10 kG, and which has an average particle diameter of 10 to 50 μm, The alloy of the magnetic powder (B) has a structure in which each of the soft magnetic crystalline phase comprising αFe, bccFe and a solid solution of αFe or bccFe and $M^2$ and the hard magnetic crystalline phase comprising $Nd_2Fe_{14}B_1$ type tetragonal crystals is precipitated into a soft magnetic amorphous phase. The ratio of the soft magnetic amorphous phase is usually not more than 10 area %, more preferably 1 to 10 area % based on the total alloy structure, and the balance is the crystalline phase comprising the soft magnetic crystalline phase and the hard magnetic crystalline phase. The ratio of the soft magnetic crystalline phase is usually not less than 50 area %, preferably 50 to 90 area % based on the total crystalline structure, and the balance is the hard magnetic crystalline phase.

The magnetic powder (B) is largely divided into the following magnet alloys (B-I) and (B-II). The magnet alloy (B-II) is specially preferable.

The magnet alloy (B-I) is a rare earth-iron-boron type magnet alloy having a composition represented by the following formula (3):

$$R_xFe_{(100-w-x-y-z)}Co_yM^3_zB_w \quad (3)$$

wherein $M^3$ is at least one element selected from the group consisting of Ti, V, Zr, Nb, Mo, Hf, Ta, W, Cu, Zn, In, Sn and Si, R is one element selected from the group consisting of Nd, Pr, Dy, Tb and Ce, x is 5 to 10 (atm %), y is 1 to 5 (atm %), z is 0.1 to 5 (atm %), w is 2 to 7 (atm %), (x+w) is not less than 9.5 (atm %), and (y+z) is 1.1 to 5 (atm %).

The magnet alloy (B-II) is a rare earth-iron-boron type magnet alloy having a composition represented by the following formula (4):

$$R_xFe_{(100-w-x-y-z)}Co_yM^2_zB_w \quad (4)$$

wherein R is one element selected from the group consisting of Nd, Pr, Dy, Tb and Ce, $M^2$ is at least one element selected from the group consisting of Ti, V, Cr, Zr, Nb, Mo, Hf, Ta, W, Mn, Cu, Ga, Zn, In, Sn, Bi, Ag and Si, x is 5 to 10 (atm %), y is 1.0 to 9.0 (atm %), z is 0.1 to 5 (atm %), w is 2 to 7 (atm %), (x+w) is not less than 9 (atm %) and (y+z) is not less than 5 (atm %).

In the composition of the magnetic powder (B-I) which is represented by the formula (3) and which is preferable from the point of view of the magnetic characteristics, x is 5 to 9, more preferably 6 to 8 (atm %), y is 1.5 to 5, more preferably 1.5 to 4.5 (atm %), z is 0.5 to 5, more preferably 0.5 to 3 (atm %), w is 3 to 7, more preferably 4 to 7 (atm %), (x+w) is 9.5 to 15, more preferably 10 to 14 (atm %), and (y+z) is 2 to 5, more preferably 3 to 5 (atm %).

In the composition of the magnetic powder (B-II) which is represented by the formula (4) which is preferable from the point of view of the magnetic characteristics, x is 5 to 9, more preferably 6 to 8 (atm %), y is 2 to 9, more preferably 3 to 9 (atm %), z is 0.3 to 5, more preferably 0.5 to 3.5 (atm %), w is 3 to 7, more preferably 3 to 6 (atm %), (x+w) is 9 to 15, more preferably 10 to 14 (atm %), and (y+z) is 5.1 to 12, more preferably 5.5 to 11 (atm %).

If the content of the rare earth element of the magnetic powder (B) exceeds 10 atm %, the content of the iron group is relatively lowered, so that it is difficult to obtain a high residual magnetic flux density (Br) such as not less than 10 kG, which is one of the characteristics of the magnetic powder (B) of the present invention. Although the lower limit is not specified, the rare earth element content is preferably not less than 5 atm % in order to maintain the intrinsic coercive force (iHc) of not less than 3.5 kOe. If the intrinsic coercive force (iHc) is less than 3.5 kOe, the degree of the reduction in the intrinsic coercive force (iHc) sometimes becomes larger than the rising effect of the mixed magnetic powder in residual magnetic flux density (Br) and, as a result, the maximum energy product ((BH)max) of not less than 11 MGOe is sometimes not obtained. On the other hand, if the intrinsic coercive force (iHc) exceeds 6.0 kOe, the residual magnetic flux density (Br) is sometimes relatively lowered, so that it is difficult to obtain a high residual magnetic flux density (Br) such as not less than 10 kG, which is one of the required properties of the magnetic powder (B) of the present invention. The preferable intrinsic coercive force (iHc) is 4.0 to 5.5 kOe. If the residual magnetic flux density (Br) is less than 10 kG, residual magnetic flux density (Br) is so small that it is difficult to produce a high-performance bonded magnet which is an objective of the present invention. The upper limit of the residual magnetic flux density (Br) is not specified, but the residual magnetic flux density (Br) is preferably not more than 15 kG in order to balance with an intrinsic coercive force (iHc) of not less than 3.5 kOe.

The magnet powder (B) has a nanocomposite alloy structure. The size of the $Nd_2Fe_{14}B_1$ type crystals for the hard magnetic crystalline phase is usually 10 to 100 nm, preferably 20 to 80 nm, and the crystal grain diameter of αFe and an iron compound for the soft magnetic crystalline phase is usually 10 to 100 nm, preferably 15 to 70 nm. If these crystal grain diameters are less than 10 nm, various superparamagnetic phenomenons are sometimes exhibited, and residual magnetic flux density (Br) may be lowered. On the other hand, if the crystal grain diameters exceed 100 nm, the intrinsic coercive force is sometimes greatly lowered.

Since the amorphous phase as the balance which occupies usually not more than 10 area %, preferably 1 to 10 area % based on the total alloy structure surrounds these crystalline phases, even if the alloy is pulverized into powder (magnetic powder (B)) having an average particle diameter of, for example, not more than 50 μm, preferably 10 to 50 μm, more preferably 20 to 50 μm, the magnetic characteristics are not greatly deteriorated. If the ratio of the amorphous phase exceeds 10 area %, the magnetic exchange interaction of the soft magnetic crystalline phase and the hard magnetic crystalline phase is weakened, and as a result, the intrinsic coercive force is sometimes lowered or an inflection point (negative curvature) is sometimes caused on a demagnetization curve. If the ratio of the amorphous phase is less than 1 area %, the powder may be susceptible to a skewness (strain) caused when the alloy is pulverized into magnetic powder, so that the intrinsic coercive force (iHc) is apt to be greatly lowered.

If the ratio of the soft magnetic crystalline phase is less than 50 area % based on the total crystalline structure of the magnetic powder (B), it is usually difficult to obtain a high residual magnetic flux density (Br) such as not less than 10 kG. Although the upper limit of the ratio of the soft magnetic crystalline phase is not specified, since it is required that the ratio of the hard magnetic crystalline phase is 10 area % based on the total crystalline structure in order to obtain an intrinsic coercive force (iHc) of not less than 3.5 kOe, the preferable upper limit of the soft magnetic crystalline phase obtained from the reduction is 90 area % based on the total crystalline structure.

The preferable magnetic powder (B) is the powder of an exchange-spring magnet. The magnetic powder (B) is generally obtained by heat-treating an amorphous alloy having the above-described composition produced by a melting method and then a rapid quenching method or the like so as to precipitate a hard magnetic crystalline phase and a soft magnetic crystalline phase each having an appropriate size from the soft magnetic amorphous phase; and pulverizing the ribbon in which these three phases coexist. The order of the heat-treatment and the pulverization may be reversed.

The magnetic powder (A) may be a known quenched alloy ribbon. It is usually that the content of a rare earth element is 8 to 11 atm %, preferably 9 to 11 atm % and that the intrinsic coercive force (iHc) is not less than 7 kOe, preferably not less than 7.5 kOe, more preferably 8 to 17 kOe for the above-described reason. The magnetic powder (A) is also generally obtained by heat-treating an amorphous alloy having the above-described composition produced by a melting method and then by a rapid quenching method or the like; and pulverizing the alloy. The order of the heat-treatment and the pulverization may be reversed. The alloy is generally comprising a single phase or a mixed phase comprising the crystal phase as a main phase and a trace amount of grain boundary phase because of the compositional limitation such as the range of the rare earth element content. Unlike the magnetic powder (B), neither a soft magnetic crystalline phase nor a soft magnetic amorphous phase is a mainly structural phase. It goes without saying, however, that the existence of a trace amount of both the soft magnetic crystalline and/or amorphous phases is allowed as an grain boundary phase or an impurity pha se.

It is necessary that when the magnetic powders (A) and (B) are mixed, the average particle diameter of the magnetic powder (A) is set to be larger than that of the magnetic powder (B) so as to obtain a high packing density of the magnetic powder (A+B) in the bonded magnet produced therefrom. If the average particle diameter of the magnetic powder (A) is set to be not less than 100 μm, it is possible to produce a bonde d magnet having high magnetic characteristics. The average particle diameter of the magnetic powder (A) is preferably 100 to 500 μm, more preferably 100 to 300 μm. The average particle diameter of the magnetic powder (B) is set to be not more than 50 μm, preferably 10 to 50 μm, more preferably 20 to 50 μm.

An ordinary method may be adopted for the pulverization and mixture of these magnetic powders (A) and (B). For example, the alloy is pulverized by a ball mill or an attrition mill, the particles are classified by a shaking or vibration screen, and the powders are mixed and stirred by a ribbon blender or a planetary blender. The mixing ratio of the magnetic powders (A) and (B) is so set as to produce the largest maximum energy product ((BH)max). Since the optimum value of this ratio fluctuates depending upon the magnetic characteristics and the average particle diameters of the magnetic powders (A) and (B), it is necessary to grasp the ratio well in advance by experiments. A binder resin (binder polymer) is added before or after mixing the powders and the mixture is compounded so as to produce a molding material.

When a compression-molded magnet is produced, an epoxy or phenol thermosetting resin is generally used as the binder resin. The amount of binder resin is usually 1.5 to 5 parts by weight based on 100 parts by weight of the mixed magnetic powder. When an injection molded magnet is produced, a polyamide (nylon), polyphenylene sulfide (PPS), or liquid crystal thermoplastic resin is generally used as the binder resin. The amount of binder resin is usually 7 to 13 parts by weight based on 100 parts by weight of the mixed magnetic powder. If an appropriate binder resin is selected, an extrusion molding and a calender roll molding can be also conducted. The rare earth bonded magnet of the present invention is especially preferably produced by compression molding in order to more efficiently produce the effects described above and high magnetic characteristics.

A compression-molded magnet will be mainly explained in the following. A small amount (preferably not more than 3 parts by weight of 100 parts by weight of mixed magnetic powder) of known additives such as plasticizer, lubricant and coupling agent in addition to the binder resin may be contained in a compression molding compound in order to facilitate the molding or adequately extract the magnetic characteristics.

It is possible to adopt a conventional method of producing an isotropic bonded magnet for compression molding. In other words, it is possible to use a commercially available press molding machine. It is advantageous that the pressure is set to be as high as industrially possible, because the higher the pressure, the higher the packing density, and the higher the residual magnetic flux density (Br), and as a result, the (BH)max of the isotropic bonded magnet.

When the compression-molded magnet is produced, the resin is usually cured in the subsequent heat-treatment step, and the magnet is then magnetized. In some cases, however, after curing the resin, the magnet is integrated with other parts and then magnetized. In any case, the magnet is generally magnetized by a pulse current.

It has been found that when a bonded magnet is produced by compression molding, from a mixed powder obtained by mixing the magnetic powder (A) having the average particle diameter adjusted to not less than 100 μm and the magnetic powder (B) having the average particle diameter adjusted to not more than 50 μm in a mixing ratio of usually 1:9 to 9:1, preferably 1.5:8.5 to 8.5:1.5 by weight ratio, a smooth demagnetization curve without scarcely any concave portion, i.e., a remarkable inflection point is obtained. In the present invention, a bonded magnet having an excellent magnetic energy product is realized by this smooth demagnetization curve.

In the isotropic bonded magnet using an Nd-type alloy of the present invention, it is inferred from the results of the experiments that a smooth demagnetization curve is obtained because a magnetic interaction works between the magnetic powders having different values of the intrinsic coercive force. It has also been confirmed that the volume ratio (packing ratio) of the total powder has a maximum value at a some mixing ratio, and the magnetic characteristics of the isotropic bonded magnet produced therefrom, particularly, residual magnetic flux density (Br) and maximum energy product ((BH)max) become higher than a simple average value, although it depends upon the particle diameters of the two magnetic powders, as shown in later-described examples.

The magnetic characteristics of the bonded magnets produced were generally measured by a B-H curve tracer. The irreversible flux loss ratio which is necessary for the evaluation of the thermal stability of a magnet was measured by a flux meter.

The rare earth bonded magnet of the present invention produced in this manner has a residual magnetic flux density (Br) of usually not less than 8 kG, preferably not less than 8.5 kG, more preferably not less than 9 kG, an intrinsic coercive force (iHc) of usually not less than 5 kOe, preferably not less than 5.5 kOe, more preferably not less than 6 kOe, a maximum energy product ((BH)max) of usually not less than 11 MGOe, preferably not less than 11.5 MGOe, more preferably not less than 12 MGOe.

A rare earth-iron-boron type magnet alloy which is particularly useful as one powder of the magnet powder (B) of the rare earth bonded magnet of the present invention will now be explained. The rare earth-iron-boron type magnet alloy has a composition represented by the following formula (5):

$$R_xFe_{(100-w-x-y-z)}Co_yM^4_zB_w \quad (5)$$

wherein R is one element selected from the group consisting of Nd, Pr, Dy, Tb and Ce, $M^4$ is at least one element selected from the group consisting of Ti, V, Cr, Zr, Nb, Mo, Hf, Ta, W, Mn, Cu, Ga, Ag and Si, x is 5 to 10 (atm %), y is 1.0 to 9.0 (atm %), z is 0.1 to 5 (atm %), w is 2 to 7 (atm %), (x+w) is not less than 9 (atm %) and (y+z) is not less than 5 (atm %).

The rare earth-iron-boron type magnet alloy has a structure in which each of a soft magnetic crystalline phase containing αFe, bccFe and a solid solution of αFe or bccFe and $M_4$, and a hard magnetic crystal line phase constituted by $Nd_2Fe_{14}B_1$ type tetragonal crystals is precipitated into a soft magnetic amorphous phase. The ratio of the soft magnetic amorphous phase is usually not more than 10 area % based on the total alloy structure of the rare earth-iron-boron type magnet alloy, and the balance is a crystalline phase comprising the soft magnetic crystalline phase and the hard magnetic crystalline phase. The ratio of the soft magnetic crystalline phase is usually not less than 50 area % based on the total crystalline structure in the rare earth-iron-boron type magnet alloy, and the balance is the hard magnetic crystalline phase. The alloy has an intrinsic coercive force (iHc) of not less than 3.5 kOe, a residual magnetic flux density (Br) of not less than 10 kG and a maximum energy product ((BH)max) of not less than 13 MGOe.

The composition of the rare earth-iron-boron magnet alloy of the present invention is represented by the formula (5).

The R in the formula (5) is at least one element selected from the group consisting of Nd, Pr, Dy, Tb and Ce and the amount of R is $5 \leqq x \leqq 10$ by atomic ratio (atm %). In the consideration of the residual magnetic flux density (Br) and the intrinsic coercive force (iHc), Nd, Pr, an Nd—Pr alloy, and Nd, Pr or an Nd—Pr alloy with at least another rare earth element added thereto are preferable. Nd and Pr are the more preferable. There is no problem that not more than 10 atm % of rare earth elements other than the above-described elements based on the total rare earth elements are contained.

The amount of R is $5 \leqq x \leqq 10$, preferably $5 \leqq x \leqq 9$, more preferably $6 \leqq x \leqq 8$ (atm %). If x is less than 5, the amount of the precipitated hard magnetic crystalline phase constituted by $Nd_2Fe_{14}B_1$ type tetragonal crystals is insufficient, so that an intrinsic coercive force of not less than 3.5 kOe is not obtained. If x exceeds 10, the amount of separated soft magnetic crystalline phase constituted by αFe, bccFe and a solid solution of αFe or bccfe and $M^4$ is insufficient, so that a residual magnetic flux density (Br) of not less than 10 kG is not obtained.

The amount of Fe is a balance with other elements and is usually in the range of 69 to 86 by atomic ratio (atm %). If it is less than 69, the residual magnetic flux density (Br) is lowered and it is difficult to obtain a residual magnetic flux density of not less than 10 kG, which is aimed at in the present invention. If the amount of Fe exceeds 86, the amounts of R and Co are relatively reduced, so that it is difficult to obtain an intrinsic coercive force of not less than 3.5 kOe, which is aimed at in the present invention.

Co as well as $M^4$ is essential because it enhances the intrinsic coercive force, increases the magnetization, improves the anticorrosiveness and/or raises the Curie point.

The amount of Co is $1.0<y<9.0$, preferably $2.0 \leqq y \leqq 9.0$, more preferably $3.0 \leqq y \leqq 9.0$. If it is less than 1.0, the increase in the intrinsic coercive force and the rise in the Curie point are sometimes insufficient, so that the thermal stability becomes inferior. If it exceeds 9.0, the lowering of the residual magnetic flux density (Br) due to a shortage of an iron component is sometimes remarkable, so that it is difficult to obtain a residual magnetic flux density of not less than 10 kG.

The $M^4$ is at least one element selected from the group consisting of Ti, V, Cr, Zr, Nb, Mo, Hf, Ta, W, Mn, Cu, Ga, Ag and Si. $M^4$ is able to enhance the crystalline magnetic anisotropy of the hard magnetic crystalline phase constituted by $Nd_2Fe_{14}B_1$ type tetragonal crystals and to produce a high intrinsic coercive force due to the effect of making the grain of the precipitated phase finer. The $M^4$ is also able to stabilize the soft magnetic crystalline phase containing αFe, bccFe and a solid solution of αFe or bccFe and $M^4$, and produce the anticorrosiveness and the thermal stability of a permanent magnet. By the synergism of the coexistence of at least one element selected from the group consisting of Mn, cu, Ga, Ag and Si, and other element(s) in $M^4$, larger intrinsic coercive force can be obtained.

The amount of $M^4$ is $0.1 \leqq z \leqq 5$, preferably $0.3 \leqq z \leqq 5$, more preferably $0.5 \leqq z \leqq 3.5$. If it is less than 0.1, the effect of enhancing the intrinsic coercive force is poor and the thermal stability is lowered. If it exceeds 5, the residual magnetic flux density (Br) is lowered due to a shortage of an iron component.

Ti, Zr, Nb, Hf, Ta, Si and Ga as $M^4$ much contribute to the enhancement of the intrinsic coercive force and are likely to form an amorphous phase, so that the amorphous phase stably remains in the alloy, which leads to an excellent anticorrosiveness, so that it is possible to produce a magnetic material having an excellent rust preventability.

B is an essential element to form the hard magnetic crystalline phase constituted by $Nd_2Fe_{14}B_1$ type tetragonal crystals. The amount of B is $2 \leqq w \leqq 7$, preferably $3 \leqq w \leqq 7$, more preferably $3 \leqq w \leqq 6$. If it is less than 2, the amount of precipitated hard magnetic crystalline phase constituted by $Nd_2Fe_{14}B_1$ type tetragonal crystals is sometimes insufficient, so that an intrinsic coercive force of not less than 3.5 kOe is not obtained. If it exceeds 7, B is excessive, which leads to the lowering of the residual magnetic flux density (Br).

The total amount of R and B is $9 \leqq (x+w)$, preferably not less than 10. If it is less than 9, an adequate soft magnetic amorphous phase is not produced by quenching, so that it is impossible to obtained $iHc \geqq 3.5$ kOe even by heat-treatment. In order to retain a high residual magnetic flux density, the upper limit of the total amount of R and B is preferably 15, more preferably 14.

The total amount of Co and $M^4$ is $5 \leqq (y+z)$, preferably not less than 5.1, more preferably not less than 5.5. If it is not more than 5, it is difficult to produce the effect of enhancing the intrinsic coercive force and the thermal stability. In order to retain a high residual magnetic flux density, the upper limit of the total amount of Co and $M^4$ is preferably 12, more preferably 11.

The structure of a rare earth-iron-boron type magnet alloy of the present invention will now be described.

The rare earth-iron-boron type magnet alloy of the present invention has not more than 10 area % of the following residual soft magnetic amorphous phase based on the total alloy structure of the rare earth-iron-boron type magnet alloy, even after the heat-treatment.

By the analysis on elemental constitution of this residual soft magnetic amorphous phase by means of EDS (=EDX: Energy Dispersive X-ray Spectroscopy) and PEELS (Parallel Electron Energy Loss Spectroscopy), it is found that the soft magnetic amorphous phase comprises usually 8 to 20 atm % of a rare earth element, usually 70 to 90 atm % of iron or an alloy of iron and $M^4$, and usually not more than 22 atm % of boron. The soft magnetic amorphous phase only has a soft magnetism but also is able to suppress the coarse growth of crystal grains and form a fine crystal phase in the heat-treatment step for crystallization, so that it is possible to enhance the hard magnetism of the alloy as a whole.

Each of the soft magnetic crystalline phase and the hard magnetic crystalline phase are precipitated from the soft magnetic amorphous phase in the form of islands by the heat-treatment. Therefore, the soft magnetic amorphous phase surrounds the soft magnetic crystalline phase and the hard magnetic crystalline phase, which play a magnetic role, and inhibits the progress of oxidation. In other words, the soft magnetic amorphous phase works as a barrier for obstructing the development of rust, thereby enhancing the rust preventability, If the ratio of the soft magnetic amorphous phase exceeds 10 area % in a two-dimensional observation field, the distance in which the magnetic exchange interaction between the soft magnetic crystalline phase and the hard magnetic crystalline phase works is enlarged, so that the magnetic interaction is weakened and it is difficult to produce the effect of enhancing the magnetic characteristics. In order to produce the rust preventability, the lower limit of the ratio of the soft magnetic amorphous phase is preferably 1 area %.

The mechanical strength, chemical resistance, etc. in which an amorphous phase usually possesses can be well expected for this soft magnetic amorphous phase.

The soft magnetic crystalline phase of the rare earth-iron-boron type magnet alloy of the present invention comprises αFe, bccfe and a solid solution of αFe or bccFe and $M^4$, and occupies at least 50 area %, preferably not less than 55 area % based on the total crystalline structure. The soft magnetic crystalline phase contributes to the enhancement of the residual magnetic flux density (Br). If the ratio of the soft magnetic crystalline phase is less than 50 area %, it is difficult to produce the intended magnet alloy having a high residual magnetic flux density (Br). In the consideration of the ratio of the hard magnetic crystalline phase which has a role of enhancing the intrinsic coercive force (iHc), the upper limit of the ratio of the soft magnetic crystalline phase is preferably 90 area % based on the total crystalline structure.

The preferred crystal grain diameter in the soft magnetic crystalline phase is usually 10 to 100 nm, more preferably 10 to 50 nm.

The soft magnetic crystalline phase sometimes contains $Fe_3B$, $Fe_2B$, a solid solution of $Fe_3B$ or $Fe_2B$ and $M^4$, an intermetallic compound of Fe and $M^4$ such as $Fe_2Zr$ in addition to αFe, bccFe and a solid solution of αFe or bccFe and $M^4$ in a constitution phase diagram or inevitably in the production process, but there is no particular problem in the production of a magnet alloy having various properties intended by the present invention. The crystal grain diameter in the soft magnetic crystalline phase containing such inevitable inclusions is not more than 100 nm, more preferably 10 to 35 nm.

The hard magnetic crystalline phase of the rare earth-iron-boron type magnet alloy of the present invention is composed of $Nd_2Fe_{14}B_1$ type tetragonal crystals and occupies less than 50 area % based on the total crystalline structure.

The hard magnetic crystalline phase has an effect of producing a high intrinsic coercive force (iHc). A part of $M^4$ sometimes enters into the hard magnetic crystalline phase and enhances the anisotropic constant.

If the ratio of the hard magnetic crystalline phase exceeds 50 area %, the soft magnetic crystalline phase reduces, so that it is difficult to produce a large residual magnetic flux density (Br). The preferred ratio of the hard magnetic crystalline phase is not more than 45 area % based on the total crystalline structure. The lower limit is preferably 10 area % based on the total crystalline structure with due consideration of the intrinsic coercive force (iHc) intended by the present invention.

The hard magnetic crystalline phase may contain, in addition to an $Nd_2Fe_{14}B_1$ compound, a fine grain compound phase which appears as shown in a constitutional phase diagram or inevitably in the production process.

The crystal grain diameter in the hard magnetic crystalline phase is preferably not more than 100 nm, more preferably 10 to 50 nm.

In the rare earth-iron-boron type magnet alloy having the above-described composition and structure according to the present invention, the residual magnetic flux density (Br) is usually not less than 10 kG, preferably not less than 10.5 kG, the intrinsic coercive force (iHc) is usually not less than 3.5 kOe, preferably no less than 4.0 kOe, and the maximum energy product ((BH)max) is usually not less than 13 MGOe, preferably not less than 15 MGOe. The upper limits of the residual magnetic flux density (Br), the intrinsic coercive force (iHc) and maximum energy product ((BH) max) are preferably 13 kG, 8 kOe and 25 MGOe, respectively.

The process for producing a rare earth-iron-boron type magnet alloy according to the present invention will now be described.

An alloy is first produced by using metal element materials, crystal boron and alloy materials so that the alloy has a composition represented by the formula (5).

As a metal element material and crystal boron, a commercially available one is usable in any form such as powder, bulk, piece and plate. A commercially available one is also usable as an alloy material. For example, there are ferroboron as boron, and ferroneodium, Mish metal and didymium as rare earth elements. These may be used in any form such as powder, bulk, piece and plate.

The metal element materials, crystal boron and the alloy materials are mixed so as to have the above-described composition, and produced into an alloy by known arc melting method, high-frequency melting method, melt and floating method or the like. The melting step is preferably executed under a vacuum or in an inert atmosphere such as argon gas.

The alloy obtained is further heated so as to obtain a molten alloy. The heating temperature is set depending upon the alloy composition. Usually, it is preferable to heat the alloy at a temperature not less than 500° C. higher than the melting point of the alloy.

The molten alloy is quenched and solidified by known revolving roll quenching method, splat quenching method, gas atomizing method or a combination thereof so as to obtain an amorphous alloy structure containing an amorphous ribbon and amorphous coarse grains.

In the present invention, the melting under heating and the quench solidification may be serially executed in the same apparatus, if necessary.

The amorphous alloy shows a broad peak in X-ray analysis and it is also confirmed by observation through a transmission electron microscope. 100% of an amorphous alloy structure may sometimes not be obtained depending upon the quenching condition or the alloy composition, but if there is a certain extent of the amorphous alloy structure enough to attain the object of the present invention, there is no problem.

The soft magnetic amorphous phase has not only a soft magnetism but also has an important role to enhance the hard magnetism of the alloy as a whole by suppressing the coarse growth of crystal grains and forming a fine crystal phase in the heat-treatment step for crystallization.

The heating temperature for crystallizing the quenched and solidified alloy is usually 600° to 850° C., preferably 650° to 800° C., If the temperature is lower than 600° C., the hard magnetic crystalline phase of $Nd_2Fe_{14}B_1$ type tetragonal crystals is sometimes not adequately precipitated, so that it is difficult to obtain an intrinsic coercive force of not less than 3.5 kOe. If the temperature exceeds 850° C., the coarse growth of the soft magnetic crystalline phase containing αFe, bccFe and a solid solution of αFe or bccFe and $M^4$ may become remarkable, and a high intrinsic coercive force is difficult to obtain. In addition, since the ratio of the residual soft magnetic amorphous phase is greatly lowered, an excellent rust preventability is difficult to produce. The optimum heat-treatment temperature for imparting good magnetic characteristics is appropriately selected in accordance with the composition of the quenched and solidified alloy.

The atmosphere for heat-treatment is not specifically determined so long as it does not impair the magnetic characteristics of the magnet alloy obtained, but an inert atmosphere such as Ar gas or a vacuum of not more than $10^{-10}$ Torr is preferable.

If the heat-treating time is less than 10 seconds, the soft magnetic crystalline phase and the hard magnetic crystalline phase may not be precipitated. On the other hand, if it exceeds one hour, the coarse grains of the soft magnetic crystalline phase grow. In neither case, a coercive force of not less than 3.5 kOe is obtained. The preferable heat-treating time is 1 to 30 minutes.

By the heat-treatment, the crystalline phases are produced from the amorphous phase. At this time, it is important to heat the alloy so as not to completely crystallize the amorphous phase but to leave not more than 10 area % of the amorphous phase based on the total alloy structure.

In order to leave the amorphous phase, it is necessary to set the heating conditions so that the precipitation and the growth of the crystalline phases do not reach all over the amorphous phase. Since it is possible to stabilize the amorphous phase and suppress the growth of the precipitated phases by the effect of the element $M^4$ added, it is also important to set an appropriate alloy composition. A flash annealing method or a rapid-heating rapid-cooling method may be adopted for the heat-treatment, but an ordinary heat-treatment sometimes suffices depending upon the alloy composition.

The ratio of the residual amorphous phase is preferably 1 to 10 area % based on the total alloy structure. If is less than 1 area %, the intended effect may not be obtained, nor the rust preventability may be expected. If it exceeds 10 area %, the magnetic interaction between the amorphous phase and a crystalline phase or between the crystalline phases is sometimes weakened.

The process for producing a bonded magnet produced from the rare earth-iron-boron type magnet alloy of the present invention will now be described.

It is possible to produce a bonded magnet by a known process by using the magnetic alloy powder of the present invention.

A rare earth-iron-boron type magnet alloy of the present invention is pulverized by a commercially available mill such as a ball mill and a stamp mill. The rare earth-iron-boron type magnet alloy powder obtained is mixed and kneaded with a resin as a binder, and the kneaded powder is molded by a known molding method such as injection molding, extrusion molding, compression molding and calender roll molding.

The average particle diameter of the rare earth-iron-boron type magnet alloy powder can be varied in accordance with the molding method adopted depending upon the objective, but it is usually not more than 500 $\mu$m. If a large amount of fine powder having an average particle diameter of not more than 10 $\mu$m is mixed, the magnetic characteristics are deteriorated, so that the lower limit of the average particle diameter is about 10 $\mu$m. However, if the amount of fine powder having an average particle diameter of not more than 10 m is not more than 15 wt % based on the total powder, there is no problem. The preferable average particle diameter of the rare earth-iron-boron type magnet alloy powder is 20 to 300 $\mu$m.

The mixing ratio of the rare earth-iron-boron type magnet alloy powder in the bonded magnet is generally 85 to 99 wt %. The ratio is slightly different depending upon the molding method, but the mixing ratio of the rare earth-iron-boron type magnet alloy powder in the bonded magnet is usually about 88 to 93 wt % in injection molding, about 85 to 92 wt % in extrusion molding, about 96 to 99 wt % in compression molding, and about 85 to 90 wt % in calender roll molding.

If the ratio of the rare earth-iron-boron type magnet alloy powder in the bonded magnet is less than 85 wt %, the ratio of the magnet powder is so small that the bonded magnet does not have sufficient magnetic characteristics. However, there is a case where a magnet with low magnetic characteristics is required for some uses. In such a case, the ratio of the rare earth-iron-boron type magnet alloy powder is set at not more than 85 wt %. The upper limit of the mixing ratio of the magnet powder in each molding method is determined in accordance with the fluidity of a kneaded material or a mixed material of the magnet powder and a resin and the mechanical strength required of the molded product.

Known additives such as plasticizer, lubricant and coupling agent may be added in addition to the resin in order to facilitate the molding and sufficiently draw out the magnetic characteristics.

These additives are appropriately selected depending upon the objective. As a plasticizer, a commercially available one is usable in accordance with the resin used. The amount of plasticizer used is about 0.01 to 5.0 wt % based on the resin used.

Examples of a lubricant are stearic acid, derivatives thereof, inorganic lubricants and oil lubricants. The amount of lubricant used is about 0.01 to 1.0 wt % based on the bonded magnet.

As a coupling agent, a commercially available one is usable in accordance with a resin used and a filler. The amount of coupling agent used is about 0.01 to 3.0 wt % based on the resin used.

It is possible to produce a bonded magnet by magnetizing the molded product produced from the rare earth-iron-boron type magnet alloy as a magnetic material, by using an electromagnet or a pulse current magnetizer.

In the bonded magnet produced from the rare earth-iron-boron type magnet alloy of the present invention and a binder resin, the residual magnetic flux density (Br) is usually not less than 6.0 kG, preferably not less than 7.5 kG, the intrinsic coercive force (iHc) is usually not less than 3.5 kOe, preferably not less than 4.0 kOe, and the maximum energy product ((BH)max) is usually not less than 8 MGOe, preferably not less than 9 MGOe.

The anticorrosiveness of the bonded magnet, which is represented by the time elapsed before the rust gathered, for example, at 80° C. and a relative humidity of 90% occupies 10 area % based on the total surface of magnets is usually at least not less than 96 hours, preferably not less than 120 hours.

The rust preventability of the alloy ribbon represented by the time elapsed before the rust gathered by, for example, salt spray based on JIS Z 2371 occupies 10 area % based on the total surface of magnets is usually at least not less than 50 hours, preferably not less than 55 hours, more preferably not less than 60 hours. This is distinctly more excellent than the rust preventability of a conventional Nd—Fe—B alloy, as will be shown in later-described examples.

What is the most important in the present invention is the fact that a rare earth-iron-boron type magnet alloy having a composition represented by the formula (5):

$$R_xFe_{(100-w-x-y-z)}Co_yM^4_zB_w \quad (5)$$

wherein R is one element selected from the group consisting of Nd, Pr, Dy, Tb and Ce, $M^4$ is at least one element selected from the group consisting of Ti, V, Cr, Zr, Nb, Mo, Hf, Ta, W, Mn, Cu, Ga, Ag and Si, x is 5 to 10 (atm %), y is 1.0 to 9.0 (atm %), z is 0.1 to 5 (atm %), w is 2 to 7 (atm %), (x+w) is not less than 9 (atm %) and (y+z) is not less than 5 (atm %), and having a structure in which each of a soft magnetic crystalline phase containing αFe, bccfe and a solid solution of αFe or bccfe and $M^4$, and a hard magnetic crystalline phase constituted by $Nd_2Fe_{14}B_1$ type tetragonal crystals is precipitated from a soft magnetic amorphous phase, in which the ratio of the soft magnetic amorphous phase is usually not more than 10 area % based on the total alloy structure of the rare earth-iron-boron type magnet alloy, and the balance is a crystalline phase comprising the soft magnetic crystalline phase and the hard magnetic crystalline phase, and in which the ratio of the soft magnetic crystalline phase is usually not less than 50 area % based on the total crystalline structure in the rare earth-iron-boron type magnet alloy, and the balance is the hard magnetic crystalline phase, has an intrinsic coercive force (iHc) of not less than 3.5 kOe, a residual magnetic flux density (Br) of not less than 10 kG and a maximum energy product ((BH)max) of not less than 13 MGOe.

The reason why the rare earth-iron-boron permanent magnet obtained has such a large intrinsic coercive force (iHc) is considered to be that the synergism of Co element and the specific $M^4$ element produces an effect of enhancing the magnetic anisotropy of the $Nd_2Fe_{14}B_1$ type tetragonal crystals and the effect of making the precipitated grains finer from the fact that it is impossible to produce a rare earth-iron-boron bonded (permanent) magnet as an objective of the present invention in any of the cases where the alloy contains only Co element without the specific $M^4$ element, where the alloy contains only the specific $M^4$ element without Co element, and where the total sum of the Co element and the $M^4$ element leaves the specified range, as will be shown in later-described comparative examples.

The reason why the rare earth-iron-boron bonded (permanent) magnet obtained has an excellent rust preventability is considered by the present inventors to be that the amorphous phase surrounds the soft magnetic crystalline phase and the hard magnetic crystalline phase, which mainly play a magnetic role, and that the amount of amorphous phase is appropriate and stable.

As described above, in spite of the low rare earth element content, the rare earth bonded magnet using the mixed magnetic powder of the present invention satisfies residual magnetic flux density (Br) of not less than 8 kOe, the intrinsic coercive force (iHc) of not less than 5 kOe and the maximum energy product ((BH)max) of not less than 11 MGOe due to a composite effect of a combination of specific magnetic powders. That is, the present invention is able to provide a high-performance Nd-type bonded magnet economically.

The rare earth-iron-boron type magnet alloy of the present invention has a high residual magnetic flux density (Br), a large intrinsic coercive force (iHc), and as a result, a large maximum energy product ((BH)max), and an excellent rust preventability. It is therefore suitable as a material for a high-performance bonded magnet.

Since the rare earth-iron-boron type magnet alloy of the present invention contains a rare earth element as small as less than 10 atm %, it is possible to obtain advantageously from the point of view of economy and industry.

In addition, the bonded magnet produced from the rare earth-iron-boron type magnet alloy of the present invention has a high residual magnetic flux density (Br) and a large intrinsic coercive force (iHc), and as a result, a large maximum energy product ((BH)max), and an excellent anticorrosiveness due to the above-described properties of the rare earth-iron-boron type magnet alloy as a material. It is therefore suitable as a high-performance bonded magnet.

EXAMPLES

The present invention will be explained in more detail hereinunder with reference to the following examples and comparative examples.

The properties in the examples and comparative examples were measured by the following methods.

(1) The phase structure and atomic composition of a rare earth-iron-boron type magnet alloy was examined by observing and measuring an alloy ribbon (20 μm in thickness) by a high resolution transmission electron microscope HR-TEM (manufactured by Japan Electron Optics Laboratory Co., Ltd.), a nanobeam electron diffractometer (manufactured by Japan Electron Optics Laboratory Co., Ltd.) and an energy dispersive X-ray analyzer EDX (manufactured by Japan Electron Optics Laboratory Co., Ltd.).

(2) As to the magnetic structure of an alloy, when αFe type crystals and $Fe_3B$ type crystals were identified by the electron beam analysis using the above-mentioned nanobeam electron diffractometer, the portion was confirmed to be soft magnetic.

Similarly, when $Nd_2Fe_{14}B_1$ type crystals were identified, the portion was confirmed to be hard magnetic.

(3) The area % means the ratio of the existence in a two-dimensional observation field of a transmission electron microscope (TEM).

(4) The alloy composition is expressed by the values obtained by chemical analysis.

(5) The magnetic characteristics of an alloy is expressed by the values measured by Vibration sample magnetometer VSM (manufactured by Riken Denshi Co., Ltd.).

(6) The magnetic characteristics of a bond magnet is expressed by the values measured by a B-H curve tracer (manufactured by Toei Kogyo, Co., Ltd.) after magnetizing the bonded magnet by pulse magnetization of about 50 kOe.

(7) The rust preventability of an alloy ribbon was examined by a salt-spraying test based on JIS Z 2371. The ribbon was taken out every predetermined period of time to examine whether or not rust was developed and the state in which rusty points increased and the rust expanded by an optical microscope of ×50 magnification. The value is the time elapsed before the rust developed occupies 10 area % based on the total alloy structure.

(8) The anticorrosiveness of a bonded magnet was evaluated by the time before the rust developed at 80° C. and a relative humidity of 90%, and the state in which rusty points increased and the rust expanded by an optical microscope of ×50 magnification. It is expressed by the time elapsed before the rust developed occupies 10 area % based on the total alloy structure.

Example 1

A quenched ribbon was produced from powder having a composition of $Nd_{11}Fe_{72}Co_8V_{1.5}B_{7.5}$ which was selected as the magnetic powder (A) which has a high intrinsic coercive force. The ribbon was heat-treated at 650° C. for 5 minutes, and pulverized into powder. As to the magnetic characteristics of the quenched alloy ribbon before the pulverization, Br=9.7 kG, iHc=12.9 kOe, and (BH)max=20.1 MGOe.

Separately, an alloy having a composition of $Nd_{7.5}Fe_{83}Co_{4.5}Nb_1B_4$ was selected as the magnetic powder (B) which was the powder of an exchange-spring magnet. After the alloy was made amorphous by a rapid quenching method, it was heat-treated at 740° C. for 3 minutes. The crystal grain diameter was 10 to 50 nm, the ratio of a soft magnetic amorphous phase was about 8 area % based on the total alloy phase, and the ratio of the soft magnetic crystalline phase was about 60 area % based on the total crystalline phase. As to the magnetic characteristics of the alloy ribbon before the pulverization, Br=11.9 kG, iHc=4.8 kOe, and (BH)max=18.8 MGOe.

The particle size was adjusted by sieving the magnetic powder (B) so that the particle size was not less than 10 μm and not more than 70 μm (average particle diameter: 50 μm), and sieving the magnetic powder (A) so that the particle size was not less than 100 μm and not more than 200 μm (average particle diameter: 150 μm). The magnetic powders (A) and (B) were mixed well in order to prepare 11 groups of mixtures in accordance with the weight ratio of the magnetic powder (B) based on the weight of the total magnetic powder, namely, 0, 10, 20, 30, 40, 50, 60, 70, 80, 90 and 100% by weight. Thereafter, a compression-molded bonded magnet was produced from each mixture under a pressure of 7 t/cm$^2$ while using about 2 wt % of an epoxy resin as a binder based on the total weight of the mixture and the resin. The magnetic characteristics of each bonded magnet at room temperature were measured by a 8-H curve tracer. The packing ratio of the magnetic powder was calculated from the volume and the density of the bonded magnet.

As to the magnetic characteristics of the compression-molded bonded magnet using singly the magnetic powder (A) (magnetic powder (B):0%), Br=7.7 kG, iHc=12.5 kOe, and (BH)max=12.2 MGOe. As to the magnetic characteristics of the compression-molded bonded magnet using singly the magnetic powder (B) (magnetic powder (B):100%), Br=9.2 kG, iHc=4.5 kOe, and (BH)max=11.1 MGOe.

FIG. 1 shows the demagnetization curve of the bonded magnet in which the ratio of the magnetic powders (A)/(B) =50/50. It is found from FIG. 1 that even if magnetic powders having different magnetic characteristics are mixed, when the particle size is appropriately adjusted, a comparatively smooth demagnetization curve without a remarkable inflection point is obtained, and that magnetic interaction works between different types of magnetic powders in the present invention. The demagnetization curve without scarcely any inflection point is obtained in all the bonded magnets produced from the mixtures having respective mixing ratios.

Figure 2:
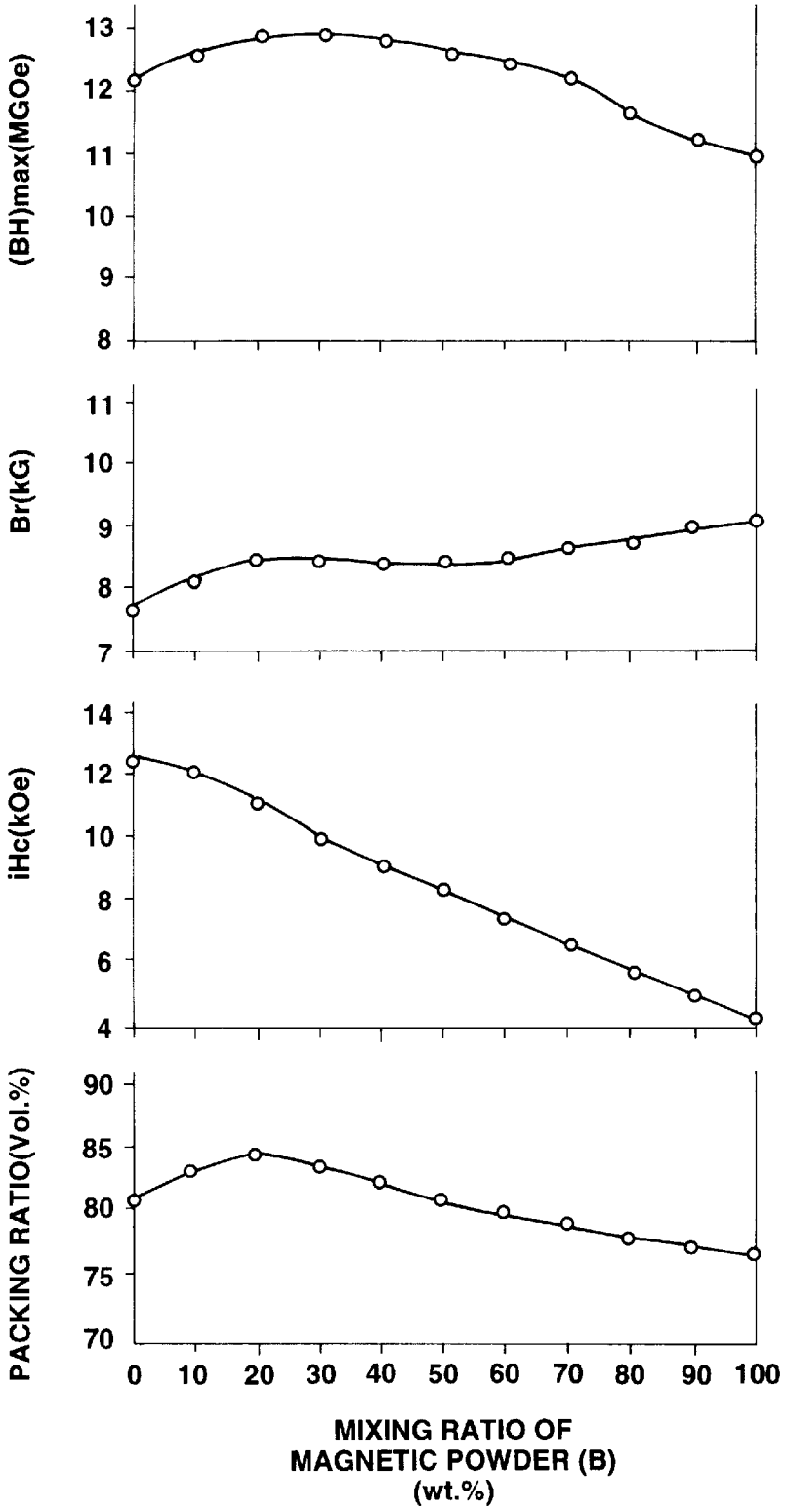
FIG. 2 shows graphs of the magnetic characteristics and the packing ratio of the rare earth bonded magnets in Example 1.

FIG. 2 shows the magnetic characteristics and the packing ratio of the magnetic powder in the bonded magnet using a mixture having each mixing ratio. It is found from FIG. 2 that the packing ratio takes the maximum value in the vicinity of the point at which the mixing ratio of the magnetic powder (B) is 20 wt %. With an increase in the packing ratio, the residual magnetic flux density (Br) also becomes larger than the average value at the same point. However, since the residual magnetic flux density (Br) of the magnetic powder (B) is larger than that of the magnetic powder (A), the residual magnetic flux density (Br) of a magnet gradually increases from the point at which the mixing ratio of the magnetic powder (B) is 50 wt %. The intrinsic coercive force (iHc) was approximately parallel with the straight line of the average values. As a result, the maximum energy product ((BH)max) takes the maximum value in the vicinity of the point at which the mixing ratio of the magnetic powder (B) is 20 wt %, but it does not suddenly drop by the influence of a change in the residual magnetic flux density (Br), but gradually lowers until the point at which the mixing ratio of the magnetic powder (B) is about 70 wt %.

Consequently, the mixing ratio of the magnetic powder (B) which satisfies the residual magnetic flux density (Br) of not less than 8 kOe, the intrinsic coercive force (iHc) of not less than 5 kOe and the maximum energy product ((BH) max) of not less than 11 MGOe intended by the present invention is 10 to 90 wt %. The maximum energy product was 13.0 MGOe in the vicinity of the point at which the mixing ratio of the magnetic powder (B) was 20%. The bonded magnet was subjected to the anticorrosiveness test at 800° C. and a relative humidity of 90% and the time elapsed before rust developed occupied 10 area % based on the total surface area was 120 hours.

Example 2

A quenched ribbon was produced from powder having a composition of $Nd_{8.5}Fe_{70}Co_{10}Zr_3Ti_{0.5}B_8$ which was selected as the magnetic powder (A) having a high intrinsic coercive force. As to the magnetic characteristics of the alloy ribbon after heat-treatment, Br=8.6 kG, iHc=11.1 kOe, and (BH)max=15.2 MGOe.

Separately, an alloy having a composition of $Nd_6Pr_1Fe_{83.5}Co_4Ti_1Ga_{0.5}B_4$ was selected as the magnetic powder (B) which was powder of an exchange-spring magnet. As to the magnetic characteristics of the alloy ribbon after heat-treatment, Br=11.6 kG, iHc=4.7 kOe, and (BH) max=18.6 MGOe. The crystal grain diameter was 20 to 60 nm, the ratio of a soft magnetic amorphous phase was about 9 area % based on the total alloy structure, and that of the soft magnetic crystalline phase was about 65 area % based on the total crystalline structure.

The particle size was adjusted by sieving the magnetic powder (B) so that the particle size was not more than 50 μm (average particle diameter: 35 μm), and sieving the magnetic powder (A) so that the particle size was not less than 100 μm and not more than 250 μm (average particle diameter: 175 μm). A compression-molded bonded magnet was produced from each mixture in the same way as defined in Example 1 and the magnetic characteristics were measured.

As to the magnetic characteristics of the compression-molded bonded magnet using singly the magnetic powder (A), Br=6.7 kG, iHc=10.7 kOe, and (BH)max=9.3 MGOe. As to the magnetic characteristics of the compression-molded bonded magnet using singly the magnetic powder (B), Br=9.0 kG, iHc=4.5 kOe, and (BH)max=10.8 MGOe.

Figure 3:
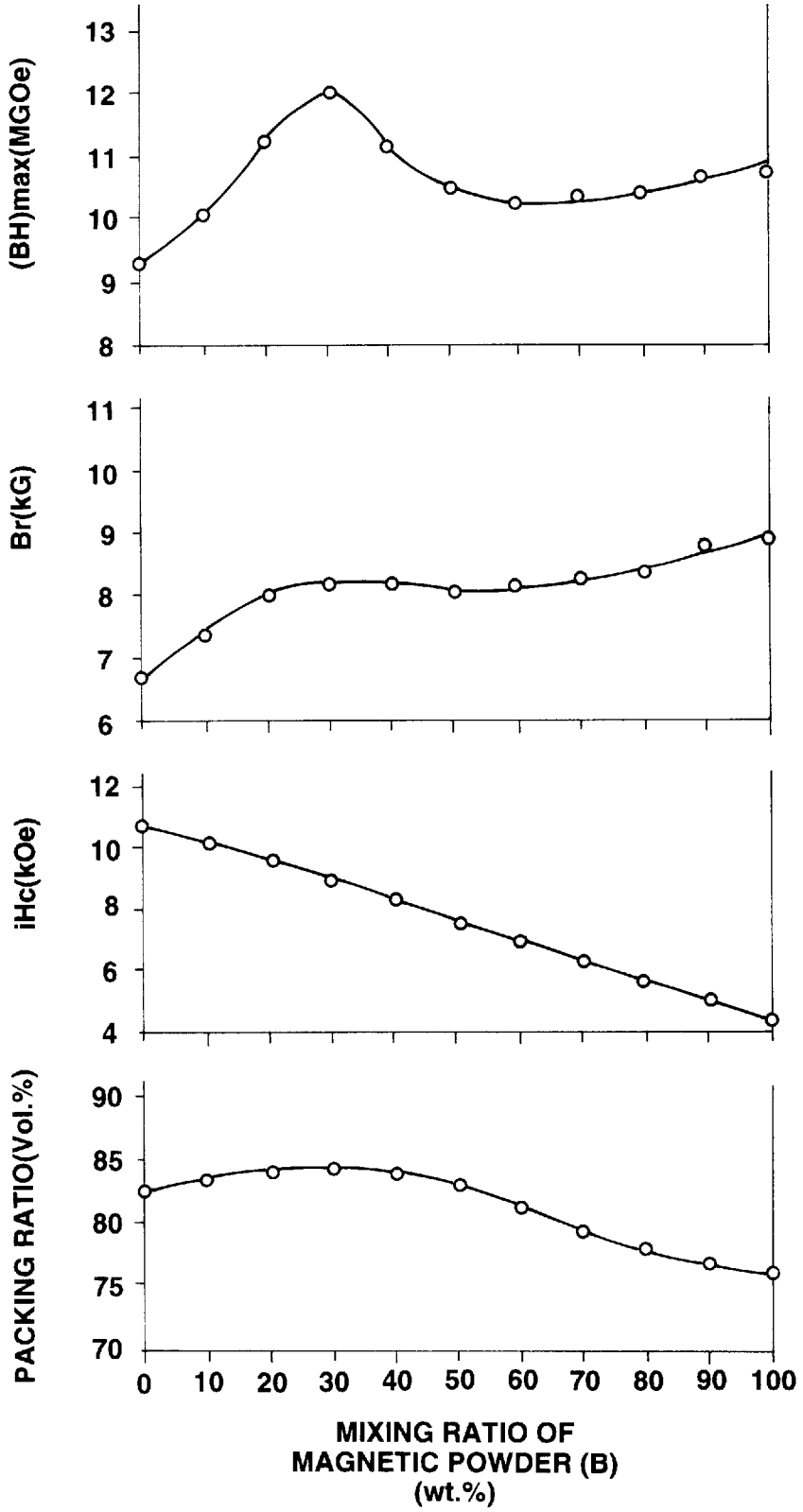
FIG. 3 shows graphs of the magnetic characteristics and the packing ratio of the rare earth bonded magnets in Example 2.

FIG. 3 shows the magnetic characteristics and the packing ratio of the magnetic powder in the bonded magnet using a mixture having each mixing ratio. It is found from FIG. 3 that the packing ratio takes the maximum value in the vicinity of the point at which the mixing ratio of the magnetic powder (B) is 30 wt %.

Consequently, the mixing ratio of the magnetic powder (B) which satisfies the residual magnetic flux density (Br) of not less than 8 kOe, the intrinsic coercive force (iHc) of not less than 5 kOe and the maximum energy product ((BH) max) of not less than 11 MGOe intended by the present invention is 20 to 40 wt %. The maximum energy product was 12.0 MGOe in the vicinity of the point at which the mixing ratio of the magnetic powder (B) was 30 wt %. The bonded magnet was subjected to the anticorrosiveness test at 80° C. and a relative humidity of 90% and the time elapsed before rust developed occupied 10 area % based on the total surface area was 106 hours.

Example 3

A quenched ribbon was produced from powder having a composition of $Nd_9Dy_{0.5}Fe_{7.5}Co_{10}Ni_1Nb_3B_6$ which was selected as the magnetic powder (A) having a high intrinsic coercive force. As to the magnetic characteristics of the alloy ribbon after heat-treatment, Br=8.4 kG, iHc=12.9 kOe, and (BH)max=14.7 MGOe. The ribbon was pulverized and sieved so that the particle size was not more than 100 μm and not less than 300 μm (average particle diameter: 200 μm). As to the magnetic characteristics of the compression-molded bonded magnet using singly the magnetic powder (A), Br=6.5 kG, iHc=12.4 kOe, and (BH)max=9.0 MGOe.

Separately, an alloy having a composition of $Nd_8Fe_{78}Co_7V_2B_5$ was selected as the magnetic powder (B) which was powder of an exchange-spring magnet and a quenched ribbon was produced. As to the magnetic characteristics of the alloy ribbon after heat-treatment, Br=12.1 kG, iHc=5.0 kOe, and (BH)max=19.7 MGOe. The crystal grain diameter was 10 to 40 nm, the ratio of a soft magnetic amorphous phase was about 7.5 area % based on the total alloy structure, and the ratio of the soft magnetic crystalline phase was about 60 area % based on the total crystalline structure. The ribbon was pulverized and sieved so that the particle size was not more than 40 μm (average particle diameter: 30 μm) to produce the magnetic powder (B). As to the magnetic characteristics of the compression-molded bonded magnet using singly the magnetic powder (B), Br=9.3 kG, iHc=4.6 kOe, and (BH)max=11.5 MGOe.

Figure 4:
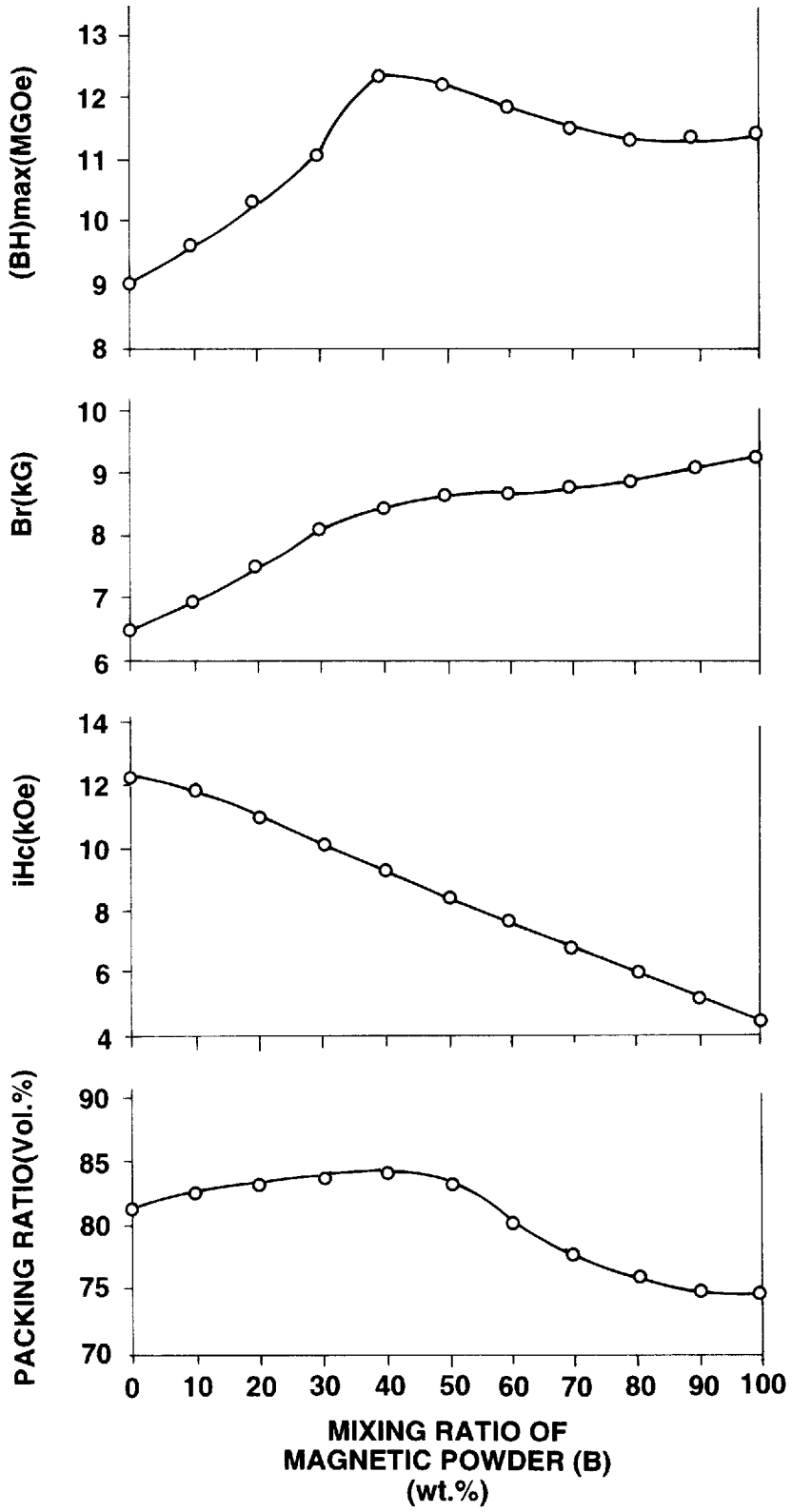
FIG. 4 shows graphs of the magnetic characteristics and the packing ratio of the rare earth bonded magnets in Example 3.

Bonded magnets were produced in the same way as in Example 1 while varying the mixing ratio of the magnetic powder (B), and the magnetic characteristics and the packing ratio of the magnetic powder were measured. The results are shown in FIG. 4. It is found from FIG. 4 that the packing ratio takes the maximum value in the vicinity of the point at which the mixing ratio of the magnetic powder (B) is 40 wt %. Consequently, the mixing ratio of the magnetic powder (B) which satisfies the residual magnetic flux density (Br) of not less than 8 kOe, the intrinsic coercive force (iHc) of not less than 5 kOe and the maximum energy product ((BH) max) of not less than 11 MGOe intended by the present invention is 30 to 70 wt %. The maximum energy product was 12.3 MGOe in the vicinity of the point at which the mixing ratio of the magnetic powder (B) was 40 wt %. The bonded magnet was subjected to the anticorrosiveness test at 80° C. and a relative humidity of 90 wt % and the time elapsed before rust developed occupied 10 area % based on the total surface area was 114 hours.

The properties of the magnetic powders (A) and (B) used in Examples 1 to 3 in Table 1.

Each of the rare earth bonded magnets produced from the magnetic powder (A) selected from the following and the magnetic powder (B) selected from the following had also similar effects to those in Examples 1 to 3.

As the magnetic powder (A):

(A1) $Nd_{11}Fe_{79}Nb_2Ta_2B_6$;
(A2) $Nd_8Fe_{70}Co_{10}Zr_3Ti_1B_8$;
(A5) $Nd_8Fe_{79.5}Cr_{4.5}B_8$;
(A6) $Nd_8Fe_{71}Co_{10}Zr_3B_8$;
(A7) $Nd_8Fe_{70}Co_{10}Zr_3Ti_1B_8$;
(A8) $Nd_{8.5}Fe_{71.5}Co_8Cu_1Ti_3B_8$;
(A9) $Nd_{8.5}Fe_{83.5}V_3B_5$;
(A10) $Nd_9Fe_{72}Co_{10}V_{1.5}B_{7.5}$;
(A11) $Nd_9Fe_{79.5}Mn_1Zr_3B_{7.5}$;
(A12) $Nd_9Fe_{72}Co_7Ta_4B_8$;
(A13) $Nd_9Fe_{70.5}Co_{12}Nb_{3.5}B_5$;
(A14) $Nd_9Fe_{73.5}Co_7Cr_4B_{6.5}$;
(A15) $Nd_{9.5}Fe_{70.5}Co_{10}Ni_1Nb_3B_6$;
(A16) $Nd_{9.5}Fe_{72}Co_7Zr_4B_{7.5}$;
(A17) $Nd_{10}Fe_{71}Co_{10}V_{1.5}B_{7.5}$;
(A18) $(Nd_7Pr_3)\ Fe_{66}Co_{16}V_1B_7$;
(A19) $Nd_{10.5}Fe_{82.5}Zr_2B_5$;
(A20) $Nd_{10.5}Fe_{82.5}Nb_2B_5$;
(A21) $Nd_{10.5}Fe_{72.5}Co_{10}Nb_2B_5$;
(A22) $Nd_{10.5}Fe_{75.5}Co_7W_2B_5$;
(A23) $Nd_{10.5}Fe_{70.5}Co_{10}Mo_4B_5$;
(A24) $Nd_{10.5}Fe_{72.5}Co_{10}Hf_2B_5$;
(A25) $(Nd_8Pr_{2.5})Fe_{75.5}Co_7V_2B_5$;
(A26) $Nd_{11}Fe_{79}Nb_2Ta_2B_6$;
(A27) $Nd_{11}Fe_{72}Co_8V_{0.5}B_{8.5}$;
(A28) $(Nd_9Pr_2)Fe_{70}Co_{10}Nb_2Ta_1B_6$; and
(A29) $(Nd_{10}Pr_1)Fe_{69}Co_{10}Nb_2Ta_2B_6$.

As the magnetic powder (B):

(B1) $Nd_7Fe_{82}Co_6Ti_1B_4$;
(B2) $Nd_7Fe_{83}Co_5V_1B_4$;
(B3) $Nd_7Fe_{83}Co_{2.5}Cr_{3.5}B_4$;
(B4) $Nd_7Fe_{83.5}Co_2Mn_{3.5}B_4$;
(B5) $Nd_7Fe_{81.5}Co_7Cu_{0.5}B_4$;
(B6) $Nd_7Fe_{83.5}Co_3Ga_{2.5}B_4$
(B7) $Nd_7Fe_{82}Co_{6.5}Zr_{0.1}B_4$;
(B8) $Nd_7Fe_{83.5}Co_{4.5}Nb_1B_4$;
(B9) $Nd_7Fe_{83.5}Co_{3\ 5}Mo_2B_4$;
(B10) $Nd_7Fe_{80}Co_{8.7}Hf_{0.3}B_4$;
(B11) $Nd_7Fe_{83}Co_5Ta_1B_4$;
(B12) $Nd_6Pr_1Fe_{83}Co_4W_2B_4$;
(B13) $Nd_5Pr_2Fe_{82}Co_{5.5}Si_{1.5}B_4$;
(B14) $Nd_6Fe_{82}Co_4Nb_1V_1B_6$;
(B15) $Nd_7Fe_{82.5}Co_4Nb_1Cu_{0.5}B_5$;
(B16) $Nd_8Fe_{82}Co_4Cr_2Mn_1B_3$;
(B17) $Nd_6Pr_1Fe_{83.5}Co_4Ti_1Ga_{0.5}B_4$; and
(B18) $Nd_5Pr_3Fe_{82}Co_4Ta_1Si_1B_4$.

Example 4

5.08 g of a neodium metal piece (purity: 99.9%, produced by Nippon Yttrium Co., Ltd.), 23.02 g of an iron metal piece (electrolytic iron, purity: 99.9%, produced by Showa Denko Co., Ltd.), 1.164 g of a cobalt metal piece (purity: 99.9%, produced by Sumitomo Metal Mining Co., Ltd.), 0.458 g of a niobium metal piece, 0.172 g of a gallium metal piece and 0.214 g of a crystal boron piece were weighed so that the mixture had a composition of $Nd_7Fe_{83.5}Co_4Nb_1Ga_{0.5}B_4$ and the total weight was 30 g. The mixture was produced into an alloy button by arc melting in an argon gas atmosphere under a reduced pressure. In order to produce a homogeneous button, the alloy button was alternately turned up and down in 4 cycles of arc melting.

The alloy button was broken into small pieces, and 5 g of the alloy pieces were charged into a quartz nozzle (tube diameter: 10 mm, length: 20 cm, nozzle diameter: 0.4 mm) and was set in a rapid quenching apparatus. After the alloy pieces were melted at a high frequency electric wave in an argon gas atmosphere under a reduced pressure, the molten alloy was jetted onto a copper roll (diameter: 20 cm) which rotates at a surface velocity of 40 m/sec while pressured argon gas was blown into the nozzle. The molten alloy was quenched and solidified and an ultrarapidly quenched alloy ribbon having a width of 1 to 2 mm and a thickness of 10 to 20 μm was produced.

In the X-ray analysis of the alloy ribbon obtained, a broad peak was observed as a whole. From the result of the X-ray analysis and the observation through the high resolution transmission electron microscope, it was confirmed that at least a great part of the alloy was constituted by an amorphous phase. When the ratio of the constitutional elements of the alloy ribbon was measured by chemical analysis, the composition was confirmed to be $Nd_7Fe_{83.5}Co_4Nb_1Ga_{0.5}B_4$, which was substantially equal to the composition ratio of the starting material.

The alloy ribbon was enclosed into a quartz tube under a vacuum of $5\times10^{-2}$ Torr and heat-treated at 750° C. for 3 minutes. When the alloy ribbon after the heat-treatment was subjected to X-ray analysis, a distinct peak based on an αFe type crystal structure and an $Nd_2Fe_{14}B_1$ type crystal structure, and a low peak which was considered to be an $Fe_3B$ type were detected. Since the background had a broad and gentle peak, it was estimated that the amorphous phase remained to some extent.

The fine structure of the alloy ribbon after the heat-treatment was observed by the high resolution transmission electron microscope, the nanobeam electron diffractometer and the energy dispersive X-ray analyzer. In the alloy structure, the ratio of the soft magnetic crystalline phase containing αFe type crystals was about 65 area % based on the total crystalline structure (wherein the soft magnetic crystalline phase containing $Fe_3B$ type crystals which inevitably separated out was about 7 area % based on the total crystalline structure), and the ratio of the hard magnetic crystalline phase containing $Nd_2Fe_{14}B_1$ type crystals was about 28 area % based on the total crystalline structure. The sum of these crystalline phases was 91 area % based on the total alloy structure if it is assumed that the entire two-dimensional field was 100 area %. Consequently, the residual 9 area % based on the total alloy structure was equivalent to the soft magnetic amorphous phase.

The crystal grain diameter in the soft magnetic crystalline phase containing αFe and bccFe type crystals was 20 to 45 nm, the crystal grain diameter in the soft magnetic crystalline phase containing $Fe_3B$ type crystals was 15 to 35 nm, and the crystal grain diameter in the hard magnetic crystalline phase containing $Nd_2Fe_{14}B_1$ type crystals was 15 to 40 nm. Thus, it was observed that each phase was dispersed, precipitated and crystallized from the amorphous phase before the heat-treatment. It was also confirmed from the result of analysis that 11.3 atm % of Nd and 7.8 atm % of B existed in the residual amorphous phase in the concentrated state.

When the magnetic characteristics of the alloy ribbon after the heat-treatment were measured at room temperature by the vibration sample magnetometer, the intrinsic coercive force (iHc) was 4.7 kOe, the residual magnetic flux density (Br) was 11.2 kG and the maximum energy product ((BH)max) was 17.4 MGOe.

In order to examine the rust preventability of the rare earth-iron-boron type magnet alloy according to JIS Z 2371, it was taken out every 12 hours and the areal ratio of the red rust on the surface of the ribbon was observed through the optical microscope. Since the time elapsed before the rust developed occupied 10 area % based on the total surface area was 72 hours, it was found that this alloy also had an excellent anticorrosiveness.

Example 5

The alloy ribbon after the heat-treatment in Example 4 was pulverized by a ball mill and sieved so as to obtain magnet alloy powder having a particle diameter of not more than 150 μm and not less than 20 μm.

98 g of the magnet alloy powder and 2 g of epoxy resin XW-2214 (trade name, produced by Nippon Perknocks Co., Ltd.) were dissolved in an appropriate amount of methyl ethyl ketone, and the powder was well mixed. Methyl ethyl ketone was then dried and vaporized, and the mixture (equivalent to 98 wt % of the magnet alloy powder and 2 wt % of the epoxy resin) obtained was used for compression molding.

3.3 g of the obtained mixture was charged into a columnar sample press jig having a diameter of 10 mm, and pressed under a pressure of about 7 ton/cm$^2$ to obtain a columnar green compact.

The green compact was heat-treated at 150° C. for one hour so as to cure the epoxy resin. In this manner, a compression-molded bonded magnet having a density of 6.0 g/cm$^3$ was produced.

After the compression-molded bonded magnet was magnetized by a pulse magnetizer which have a magnetizing force of about 50 kOe, the magnetic characteristics at room temperature was measured by the B-H curve tracer. The residual magnetic flux density (Br) was 9.0 kG, the intrinsic coercive force (iHc) was 4.6 kOe and the maximum energy product ((BH)max) was 1.2 MGOe.

The bonded magnet was subjected to the anticorrosiveness test at 80° C. and a relative humidity of 90% and the state of developing rust with the time elapsed was observed. In the observation through the optic microscope (×50 magnification) every 12 hours, several points of rust having a size of 0.1 mm at most were first detected 72 hours after the test. Observation was further continued every 12 hours in the same filed of view. Even 168 hours elapsed, the rust occupied only 10 area % in the field of view. It was thus found that the bonded magnet also had an excellent anticorrosiveness.

Examples 6 to 23, Comparative Examples 1 to 9

Alloy ribbons subjected to heat-treatment were obtained in the same way as defined in Example 4 except for varying the composition of alloys produced and the heat-treatment temperature in the production of the alloy ribbons.

The phase structure of each alloy ribbon after heat-treatment was observed in the same way as defined in Example 4.

In each of Example 6 to 23, the ratio of the soft magnetic crystalline phase containing αFe type crystals was about 60 to 75 area % based on the total crystalline structure (wherein the soft magnetic crystalline phase containing $Fe_3B$ type crystals which inevitably separated out was about 7 area % based on the total crystalline structure), and the ratio of the hard magnetic crystalline phase containing $Nd_2Fe_{14}B_1$ type crystals was not less than 25 area % and less than 40 area % based on the total crystalline structure. The sum of these crystalline phases was 90 to 95 area % based on the total alloy structure if it is assumed that the entire two-dimensional field was 100 area %. Consequently, the residual 5 to 10 area % was equivalent to the soft magnetic amorphous phase.

The crystal grain diameter in the soft magnetic crystalline phase containing αFe and bccFe type crystals was 15 to 50 nm, the crystal grain diameter in the soft magnetic crystalline phase containing $Fe_3B$ type crystals was 15 to 35 nm, and the crystal grain diameter in the hard magnetic crystalline phase containing $Nd_2Fe_{14}B_1$ type crystals was 15 to 50 nm. Thus, it was observed that each phase was dispersed, precipitated and crystallized from the amorphous phase as the state before the heat-treatment. It was also confirmed from the result of analysis that 10 to 15 atm % of Nd and 7 to 9 atm % of B existed in the residual amorphous phase in the concentrated state.

In Comparative Examples 1 and 3, the alloy did not contain Co and $M^4$, in Comparative Examples 2 and 4, the alloy did not contain $M^4$, in Comparative Examples 5 and 6, the alloy contained only specific $M^4$ without Co, in Comparative Example 7, the sum of the amount of Co and $M^4$ in the alloy was not more than 5 atm %, and in Comparative Examples 8 and 9, the alloy was an $Fe_3B$-NdFeB type exchange-spring magnet alloy.

The fine structure in each of Comparative Examples 1 to 4 was substantially the same as that in the present invention. In Comparative Examples 8 and 9, however, it was confirmed that the $Fe_3B$-NdFeB type soft magnetic crystalline phase occupied not less than 60 area % based on the total crystalline structure and that no amorphous phase substantially existed.

The main producing conditions and various properties are shown in Table 2.

From the above results it is obvious that the alloy according to the present invention is more excellent in the magnetic characteristics and the rust preventability than those in Comparative Examples 1 to 9.

Example 24 to 29, Comparative Examples 10 to 13

Bonded magnets were produced in the same way as defined in Example 5 except for varying the kind of magnet alloy powder.

The main producing conditions and various properties are shown in Table 3.

It is obvious that the bonded magnet according to the present invention is more excellent in the magnetic characteristics and the anticorrosiveness than those in Comparative Examples 10 to 13.

TABLE 1

| | Ex. 1 | Ex. 2 | Ex. 3 | Comp. Ex. 1 | Comp. Ex. 2 | Comp. Ex. 3 |
|---|---|---|---|---|---|---|
| Magnetic powder (A) | | | | | | |
| Rare earth element content (atm %) | 11 | 8.5 | 9.5 | 8.5 | 8.5 | 9.5 |
| iHc of ribbon (kOe) | 12.9 | 11.1 | 12.9 | 11.1 | 11.1 | 12.9 |
| Br of ribbon(kG) | 9.7 | 8.6 | 8.4 | 8.6 | 8.6 | 8.4 |
| (BH)max of ribbon (MGOe) | 20.1 | 15.2 | 14.7 | 15.2 | 15.2 | 14.7 |
| Average particle diameter (μm) | 150 | 175 | 200 | 100 | 175 | 175 |
| Magnetic powder (B) | | | | | | |
| Rare earth element content (atm %) | 7.5 | 7 | 8 | 7 | 5 | 7 |
| iHc of ribbon (kOe) | 4.8 | 4.7 | 5.0 | 4.7 | 5.0 | 3.2 |
| Br of ribbon (kG) | 11.9 | 11.6 | 12.1 | 11.6 | 11.9 | 12.1 |
| (BH)max of ribbon (MGOe) | 18.8 | 18.6 | 19.7 | 18.6 | 17.8 | 11.9 |
| Crystalline grain diameter (nm) | 10~50 | 20~60 | 10~40 | 20~60 | 10~60 | 10~50 |
| Amorphous phase(area %) | about 8 | about 9 | about 7.5 | about 9 | 0 | about 9.5 |
| Soft magnetic crystalline phase (area %) | about 60 | about 65 | about 60 | about 65 | about 70 | about 75 |
| Average particle diameter (μm) | 50 | 35 | 30 | 100 | 40 | 35 |

TABLE 2

| | Composition of alloy produced | Production of alloy ribbon Heat-treating temperature (°C.) |
|---|---|---|
| Ex. 6 | $Nd_7 Fe_{82} Co_6 Ti_1 B_4$ | 700 |
| Ex. 7 | $Nd_7 Fe_{83} Co_5 V_1 B_4$ | 700 |
| Ex. 8 | $Nd_7 Fe_{83} Co_{2.5} Cr_{3.5} B_4$ | 680 |
| Ex. 9 | $Nd_7 Fe_{83.5} Co_2 Mn_{3.5} B_4$ | 680 |
| Ex. 10 | $Nd_7 Fe_{81.5} Co_7 Cu_{0.5} B_4$ | 680 |
| Ex. 11 | $Nd_7 Fe_{83.5} Co_3 Ga_{2.5} B_4$ | 700 |
| Ex. 12 | $Nd_7 Fe_{82} Co_{6.5} Zr_{0.5} B_4$ | 720 |
| Ex. 13 | $Nd_7 Fe_{83.5} Co_{4.5} Nb_1 B_4$ | 720 |
| Ex. 14 | $Nd_7 Fe_{83.5} Co_{3.5} Mo_2 B_4$ | 700 |
| Ex. 15 | $Nd_7 Fe_{80} Co_{8.7} Hf_{0.3} B_4$ | 740 |
| Ex. 16 | $Nd_7 Fe_{83} Co_5 Ta_1 B_4$ | 740 |
| Ex. 17 | $Nd_6 Pr_1 Fe_{83} Co_4 W_2 B_4$ | 720 |
| Ex. 18 | $Nd_5 Pr_2 Fe_{82} Co_{5.5} Si_{1.5} B_4$ | 700 |
| Ex. 19 | $Nd_6 Fe_{82} Co_4 Nb_1 V_1 B_4$ | 760 |
| Ex. 20 | $Nd_7 Fe_{82.5} Co_4 Nb_1 Cu_{0.5} B_5$ | 780 |
| Ex. 21 | $Nd_8 Fe_{82} Co_4 Cr_2 Mn_1 B_3$ | 720 |
| Ex. 22 | $Nd_6 Pr_1 Fe_{83.5} Co_4 Ti_1 Ga_{0.5} B_4$ | 700 |
| Ex. 23 | $Nd_5 Pr_3 Fe_{82} Co_4 Ta_1 Si_1 B_4$ | 680 |
| Comp. Ex. 1 | $Nd_7 Fe_{85} B_4$ | 660 |
| Comp. Ex. 2 | $Nd_7 Fe_{85} Co_4 B_4$ | 680 |
| Comp. Ex. 3 | $Nd_8 Fe_{88} B_4$ | 660 |
| Comp. Ex. 4 | $Nd_8 Fe_{85} Co_4 B_3$ | 660 |
| Comp. Ex. 5 | $Nd_7 Fe_{83.5} Nb_{5.5} B_4$ | 800 |
| Comp. Ex. 6 | $Nd_7 Fe_{86.5} Nb_{2.5} B_4$ | 780 |
| Comp. Ex. 7 | $Nd_7 Fe_{84} Co_4 Nb_1 B_4$ | 740 |
| Comp. Ex. 8 | $Nd_{5.5} Fe_{66} Co_5 Cr_5 B_{16.5}$ | 660 |
| Comp. Ex. 9 | $Nd_4 Dy_1 Fe_{72.5} Co_3 Ga_1 B_{16.5}$ | 660 |

| | Ribbon after heat-treatment | | | | |
|---|---|---|---|---|---|
| | | Magnetic characteristics | | | Rust preventability (Time elapsed before rust developed occupies 10 area %) (hr) |
| | Composition | Residual magnetic flux density (Br) (kGauss) | Intrinsic coercive force (iHc) (kOe) | Maximum energy product (BH)max (MGOe) | |
| Ex. 6 | same as that of the alloy | 10.5 | 4.2 | 15.9 | 60 |
| Ex. 7 | same as that of the alloy | 10.8 | 4.7 | 16.1 | 60 |
| Ex. 8 | same as that of the alloy | 10.2 | 5.0 | 17.1 | 84 |
| Ex. 9 | same as that | 11.4 | 4.2 | 17.8 | 72 |

TABLE 2-continued

| | | | | | |
|---|---|---|---|---|---|
| | of the alloy | | | | |
| Ex. 10 | same as that of the alloy | 10.1 | 4.1 | 14.9 | 72 |
| Ex. 11 | same as that of the alloy | 11.6 | 4.2 | 16.0 | 60 |
| Ex. 12 | same as that of the alloy | 10.2 | 4.3 | 15.6 | 60 |
| Ex. 13 | same as that of the alloy | 11.9 | 4.8 | 18.8 | 60 |
| Ex. 14 | same as that of the alloy | 11.3 | 4.0 | 17.4 | 60 |
| Ex. 15 | same as that of the alloy | 10.0 | 4.3 | 15.0 | 72 |
| Ex. 16 | same as that of the alloy | 10.6 | 4.4 | 16.2 | 60 |
| Ex. 17 | same as that of the alloy | 11.4 | 4.5 | 17.5 | 60 |
| Ex. 18 | same as that of the alloy | 10.7 | 4.6 | 17.0 | 60 |
| Ex. 19 | same as that of the alloy | 10.4 | 5.1 | 17.7 | 60 |
| Ex. 20 | same as that of the alloy | 10.7 | 4.7 | 16.8 | 60 |
| Ex. 21 | same as that of the alloy | 10.5 | 4.9 | 17.1 | 72 |
| Ex. 22 | same as that of the alloy | 11.6 | 4.7 | 18.6 | 60 |
| Ex. 23 | same as that of the alloy | 10.3 | 5.0 | 17.2 | 60 |
| Comp Ex. 1 | same as that of the alloy | 12.4 | 2.9 | 10.4 | 48 |
| Comp Ex. 2 | same as that of the alloy | 12.1 | 3.2 | 11.9 | 48 |
| Comp Ex. 3 | same as that of the alloy | 12.5 | 2.9 | 10.9 | 48 |
| Comp Ex. 4 | same as that of the alloy | 12.0 | 3.3 | 12.4 | 48 |
| Comp Ex. 5 | same as that of the alloy | 9.7 | 2.9 | 11.0 | 48 |
| Comp Ex. 6 | same as that of the alloy | 10.3 | 2.8 | 11.3 | 36 |
| Comp Ex. 7 | same as that of the alloy | 11.9 | 3.4 | 12.5 | 48 |
| Comp Ex. 8 | same as that of the alloy | 8.6 | 7.3 | 12.1 | 36 |
| Comp Ex. 9 | same as that of the alloy | 11.9 | 5.0 | 17.8 | 24 |

TABLE 3

| | | Characteristics of bonded magnet | | | |
|---|---|---|---|---|---|
| | Alloy used | Intrinsic coercive force (iHc) (kOe) | Residual magnetic flux density Br (kGauss) | Maximum energy product (BH)max (MGOe) | Anticorrosiveness (Time elapsed before the rust developed occupies 10 area %) (Hr) |
| Ex. 24 | Ex. 3 | 4.8 | 7.9 | 9.7 | 180 |
| Ex. 25 | Ex. 4 | 4.0 | 8.8 | 10.3 | 144 |
| Ex. 26 | Ex. 6 | 4.1 | 8.9 | 9.3 | 120 |
| Ex. 27 | Ex. 8 | 4.5 | 9.2 | 11.1 | 132 |
| Ex. 28 | Ex. 14 | 4.9 | 8.3 | 10.4 | 132 |
| Ex. 29 | Ex. 17 | 4.5 | 9.0 | 10.8 | 120 |
| Comp. Ex. 10 | Comp. Ex. 1 | 2.7 | 9.6 | 6.2 | 108 |

TABLE 3-continued

| | | Characteristics of bonded magnet | | | |
|---|---|---|---|---|---|
| | Alloy used | Intrinsic coercive force (iHc) (kOe) | Residual magnetic flux density Br (kGauss) | Maximum energy product (BH)max (MGOe) | Anticorrosiveness (Time elapsed before the rust developed occupies 10 area %) (Hr) |
| Comp. Ex. 11 | Comp. Ex. 2 | 3.0 | 9.7 | 7.0 | 120 |
| Comp. Ex. 12 | Comp. Ex. 8 | 7.0 | 6.9 | 7.2 | 84 |
| Comp. Ex. 13 | Comp. Ex. 9 | 4.8 | 9.3 | 10.1 | 48 |

What is claimed is:

1. A rare earth bonded magnet having a maximum energy product ((BH)max) of not less than 11 MGOe, comprising:

a magnet powder (A) represented by the following formula (1), which comprises $Nd_2Fe_{14}B_1$ type crystals, which has an intrinsic coercive force (iHc) of not less than 7 kOe and which has an average particle diameter of not less than 100 $\mu$m:

$$R_a(Fe_{(1-d)}Co_d)_{(100-a-b-c)}M^1{}_bB_c \quad (1)$$

wherein $M^1$ is at least one element selected from the group consisting of Ti, V, Cr, Zr, Nb, Mo, Hf, Ta, W, Mn, Cu and Ni, R is a least one element selected from the group consisting of Nd, Pr, Dy, Tb and Ce, a is 8 to 11, b is 0.1 to 10, c is 2 to 10 and d is 0 to 0.2;

a magnetic powder (B) represented by the following formula (2), which has an average particle diameter of not more than 50 $\mu$m:

$$R_xFe_{(100-w-x-y-z)}Co_yM^2{}_zB_w \quad (2)$$

wherein $M^2$ is at least one element selected from the group consisting of Ti, V, Cr, Zr, Nb, Mo, Hf, Ta, W, Mn, Cu, Ga, Zn, In, Sn, Bi, Ag and Si, R is one element selected from the group consisting of Nd, Pr, Dy, Tb and Ce, x is 5 to 10, y is 1 to 9, z is 0.1 to 5, w is 2 to 7, and x+w is not less than 9; and a binder resin, said rare earth bonded magnet being produced by compounding magnet powder (A), magnet powder (B) and binder resin, and molding the obtained mixture.

2. A rare earth bonded magnet according to claim 1, which has a residual magnetic flux density (Br) of not less than 8 kG and an intrinsic coercive force (iHc) of not less than 5 kOe.

3. A rare earth bonded magnet according to claim 1, wherein said magnetic powder (A) contains 8 to 10 atm % of a rare earth element and is a powder produced by pulverizing a quenched ribbon.

4. A rare earth bonded magnet according to claim 1, wherein said magnetic powder (B) contains not more than 8 atm % of a rare earth element and is a powder produced by pulverizing an exchange-spring magnet ribbon.

5. A rare earth bonded magnet according to claim 1, wherein said magnetic powder (B) comprises a crystalline phase comprising a soft magnetic crystalline phase in which the crystal grain diameter is 10 to 100 nm and a hard magnetic crystalline phase in which the crystal grain diameter is 10 to 100 nm, and an amorphous phase of not more than 10 area % based on the total alloy structure.

6. A rare earth bonded magnet according to claim 5, wherein the ratio of the soft magnetic crystalline phase is not less than 50 area % based on the total crystalline structure.

7. A rare earth bonded magnet according to claim 6, wherein the ratio of the soft magnetic crystalline phase is 50 to 90 area % based on the total crystalline structure.

8. A rare earth bonded magnet according to claim 5, wherein the ratio of the hard magnetic crystalline phase is 10 to 50 area % based on the total crystalline structure.

9. A rare earth bonded magnet according to claim 1, wherein said magnetic powder (B) has an intrinsic coercive force (iHc) of 3.5 to 6.0 kOe and a residual magnetic flux density (Br) of not less than 10 kG.

10. A rare earth bonded magnet according to claim 1, wherein said magnetic powder (B) has a composition represented by the following formula (3):

$$R_xFe_{(100-w-x-y-z)}Co_yM^3_zB_w \quad (3)$$

wherein $M^3$ is at least one element selected from the group consisting of Ti, V, Zr, Nb, Mo, Hf, Ta, W, Cu, Zn, 1n, Sn and Si, R is one element selected from the group consisting of Nd, Pr, Dy, Tb and Ce, x is 5 to 10, y is 1 to 5, z is 0.1 to 5, w is 2 to 7, (x+w) is not less than 9.5, and (y+z) is 1.1 to 5.

11. A rare earth bonded magnet according to claim 1, wherein sad magnetic powder (B) has a composition represented by the following formula (4):

$$R_xFe_{(100-w-x-y-z)}Co_yM^3_zB_w \quad (4)$$

wherein R is one element selected from the group consisting of Nd, Pr, Dy, Tb and Ce, $M^2$ is at least one element selected from the group consisting of Ti, V, Cr, Zr, Nb, Mo, Hf, Ta, W, Mn, Cu, Ga, Zn, In, Sn, Bi, Ag and Si, x is 5 to 10, y is 1.0 to 9.0, z is 0.1 to 5, w is 2 to 7, (x+w) is not less than 9 and (y+z) is not less than 5.

12. A rare earth bonded magnet according to claim 1, wherein the mixing ratio of said magnetic powder (A) and said magnetic powder (B) is 1:9 to 9:1.

13. A rare earth bonded magnet according to claim 1, wherein said binder resin is selected from the group consisting of an epoxy thermosetting resin and a phenol thermosetting resin; and said bonded magnet is produced by compression molding.

14. A rare earth bonded magnet according to claim 1, wherein said binder resin is selected from the group consisting of a polyamide thermoplastic resin, polyphenylene sulfide thermoplastic resin and liquid crystal thermoplastic resin; and said bonded magnet is produced by injection molding.

15. A rare earth-iron-boron magnet alloy having a residual magnetic flux density (Br) of not less than 10 kG and a maximum energy product ((BH)max) of not less than 13 MGO3, consisting essentially of a composition represented by the following formula (5):

$$R_xFe_{(100-w-x-y-z)}Co_yM^4_zB_w \quad (5)$$

wherein R is one element selected from the group consisting of Nd, Pr, Dy, Tb and Ce, $M^4$ is at least one element selected from the group consisting of Ti, V, Cr, Zr, Nb, Mo, Hf, Ta, W, Mn, Cu, Ga, Ag and Si, x is 5 to 9, y is 1.0 to 9.0, z is 0.1 to 5, w is 2 to 7, (x+w) is not less than 9 and (y+z) is not less than 5, which rare earth-iron-boron type magnet alloy comprises a structure in which each of a soft magnetic crystalline phase containing αFe, bccFe and a solid solution of αFe or bccFe and $M^4$ and a hard magnetic crystalline phase constituted by $Nd_2Fe_{14}B_1$ tetragonal crystals is precipitated from a soft magnetic amorphous phase, in which the ratio of said soft magnetic amorphous phase is not more than 10 area % based on the total alloy structure, and the balance is a crystalline phase comprising said soft magnetic crystalline phase and said hard magnetic crystalline phase, and in which the ratio of said soft magnetic crystalline phase is not less than 50 area % based on the total crystalline structure and the balance is said hard magnetic crystalline phase.

16. A rare earth-iron-boron type magnet alloy according to claim 15, which further has an intrinsic coercive force (iHc) of not less than 3.5 kOe.

17. A rare earth-iron-boron type magnet alloy according to claim 15, wherein said soft amorphous phase comprises 8 to 20 atm % of a rare earth element, 70 to 90 atm % of either of iron and an alloy of iron and said $M^4$, and not more than 22 atm % of boron.

18. A rare earth-iron-boron type magnet alloy according to claim 15, wherein the crystal grain diameter in said soft crystalline phase is 10 to 100 nm.

19. A rare earth-iron-boron type magnet alloy according to claim 15, wherein the crystal grain diameter in said hard crystalline phase is not more than 100 nm.

20. A process for producing a rare earth-iron-boron type magnet alloy as defined in claim 15, comprising the steps of:

producing a mixture having a composition represented by the following formula (5):

$$R_xFe_{(100-w-x-y-z)}Co_yM^3_zB_w \quad (5)$$

wherein R is one element selected from the group consisting of Nd, Pr, Dy, Tb and Ce, $M^4$ is at least one element selected from the group consisting of Ti, V, Cr, Zr, Nb, Mo, Hf, Ta, W, Mn, Cu, Ga, Ag and Si, x is 5 to 10, y is 1.0 to 9.0, z is 0.1 to 5, w is 2 to 7, (x+w) is not less than 9 and (y+z) is not less than 5;

melting said obtained mixture under heating to produce a molten alloy;

quenching and solidifying said molten alloy; and heat-treating the quenched and solidified alloy in the temperature range of 600° to 850° C.

21. A bonded magnet having a residual magnetic flux density (Br) of not less than 8 kG, and an intrinsic coercive force (iHc) of not less than 3.5 kOe a maximum energy product (BH)max of not less than 8 MGOe, produced by molding magnet alloy powder obtained by pulverizing said rare earth-iron-boron type magnet alloy as defined in claim 15 and a resin as a binder, the content of said magnet alloy powder in the bonded magnet being 85 to 99 wt %.

22. A rare earth bonded magnet according to claim 1, wherein the compounding of magnet powder (A), magnet powder (B) and binder resin is conducted by (i) mixing magnet powder (A) and magnet powder (B) and adding binder resin to the obtained mixture, (ii) adding binder resin to each of magnet powder (A) and magnet powder (B) and mixing the obtained materials with each other, or (iii) adding binder resin to magnet powder (A) or magnet powder (B) and mixing the added material and the non-added material.

23. A rare earth-iron-boron type magnet alloy produced by the process of claim 20.

24. A rare earth-iron-boron type magnet alloy having a residual magnetic flux density (Br) of not less than 10 kG and a maximum energy product ((BH)max) of not less than 13 MGOe, consisting essentially of a composition represented by the following formula (5):

$$R_xFe_{(100-w-x-y-z)}Co_yM^4_zB_w \quad (5)$$

wherein R is one element selected from the group consisting of Nd, Pr, Dy, Tb and Ce, $M^4$ is at least one element selected from the group consisting of Ti, V, Cr, Zr, Nb, Mo, Hf, Ta, W, Mn, Cu, Ga, Ag and Si, x is 5 to 9, y is 1.0 to 9.0, z is 0.1 to 5, w is 2 to 7, (x+w) is not less than 9 and (y+z) is not less than 5.

25. A rare earth-iron-boron type magnet alloy according to claim 24, which further has an intrinsic coercive force (iHc) of not less than 3.5 kOe.

26. A rare earth-iron-boron type magnet alloy according to claim 24, which further comprises a structure in which each of a soft magnetic crystalline phase containing αFe, bccFe and a solid solution of αFe or bccFe and $M^4$ and a hard magnetic crystalline phase constituted by $Nd_2Fe_{14}B_1$ type tetragonal crystals is precipitated from a soft magnetic amorphous phase, in which the ratio of said soft magnetic amorphous is not more than 10 area % based on the to tal alloy structure, and the balance is a crystalline phase comprising said soft magnetic crystalline phase and said hard magnetic crystalline phase, and in which the ratio of said soft magnetic crystalline phase is not less than 50 area % based on the to tal crystalline structure and the balance is said hard magnetic crystalline phase.

27. A rare earth-iron-boron type magnet alloy according to claim 26, wherein said soft amorphous phase comprises 8 to 20 atm % of a rare earth element, 70 to 90 atm % of either iron and an alloy of iron and said $M^4$, and not more than 22 atm % of boron.

28. A rare earth-iron-boron type magnet alloy according to claim 26, wherein the crystal grain diameter in said soft crystalline phase is 10 to 100 nm.

29. A rare earth-iron-boron type magnet alloy according to claim 26, wherein the crystal grain diameter in said hard crystalline phase is not more than 100 nm.

* * * * *